US005995061A

United States Patent [19]

Schiller

[11] Patent Number: 5,995,061

[45] Date of Patent: Nov. 30, 1999

[54] NO LOSS, MULTI-BAND, ADAPTABLE ANTENNA

[76] Inventor: Thomas H. Schiller, 1837 Granger Ave., Los Altos, Calif. 94024

[21] Appl. No.: 08/891,246

[22] Filed: Jul. 10, 1997

Related U.S. Application Data

[63] Continuation of application No. 08/557,369, Nov. 13, 1995, abandoned, which is a continuation of application No. 08/301,136, Sep. 6, 1994, abandoned, which is a continuation of application No. 07/930,191, Aug. 12, 1992, abandoned.

[51] Int. Cl.[6] ..... H01Q 21/12

[52] U.S. Cl. ..... 343/815; 343/817; 343/819

[58] Field of Search ..... 343/810–819, 343/833, 834; H01Q 21/12

[56] References Cited

U.S. PATENT DOCUMENTS

| | | | |
|---|---|---|---|
| Re. 24,413 | 1/1958 | Weiss | 343/815 |
| 2,897,497 | 7/1959 | Finneburgh | 343/819 |
| 4,604,628 | 8/1986 | Cox | 343/818 |
| 5,061,944 | 10/1991 | Powers et al. | 343/818 |

OTHER PUBLICATIONS

Leeson, David B., "Physical Design of Yagi Antennas", The American Radio Relay League; Publ. No. 151 (1992), pp. 11–70–11–73.

The American Radio Relay League, "The ARRL Antenna Book", The American Radio Relay League; Publ. No. 15 (1988), pp. 7–4–7–8.

Moxon, L.A., "HF Antennas for all Locations", Radio Society of Great Britain (1982), pp. 106–120.

*Primary Examiner*—Michael C. Wimer

*Attorney, Agent, or Firm*—Blakely, Sokoloff, Taylor & Zafman, LLP

[57] ABSTRACT

A no-loss, multi-band, adaptable Yagi style antenna employs a multi-element driven cell having a center element and one or more adjacent elements on each side of the center element. The adjacent elements of the driven cell are electrically shorter than the center element, thereby permitting the driven cell to be tuned to two or more frequency bands. The antenna is fed by a feedline connected to a common feed point at the center of the center element in the driven cell. Parasitic director elements are positioned in front of the driven cell and are tuned to the highest band of the driven cell. Parasitic reflector elements for one or more frequency bands are positioned behind the driven cell, with these elements tuned to actual operating frequencies of the antenna. The invention also provides a multi-band dipole antenna array covering three or more frequency bands comprising a set of dipole elements having a center element and one or more adjacent elements and one or more adjacent elements on each side of the center element. The adjacent elements are electrically shorter than the center element and are of unequal lengths. The antenna is fed by a feedline connected to a common feedpoint at the center of the center element of the set of dipole elements. Parasitic director elements are positioned in front of the set of dipole elements and parasitic reflector elements are positioned behind the set of dipole elements.

33 Claims, 32 Drawing Sheets

AT 30.0° ELEVATION:

| | | |
|---|---|---|
| 10.100 MHz: | IMPEDANCE | 41.2 – j 16.2 Ω (SWR REFERENCE) |
| | SWR | 1.50 |
| | FORWARD GAIN | 9.33 dBd |
| | F/B | 15.78 dB |
| 10.000 MHz: | IMPEDANCE | 31.7 – j 4.3 Ω |
| | SWR | 1.6 (1.53 WHEN MATCHED AT 10.100 MHz) |
| | FORWARD GAIN | 9.54 dBd |
| | F/B | 17.30 dB |
| 10.200 MHz: | IMPEDANCE | 50.9 + j 26.4 Ω |
| | SWR | 1.58 (1.36 WHEN MATCHED AT 10.100 MHz) |
| | FORWARD GAIN | 9.14 dBd |
| | F/B | 13.21 dB |

5-43X3 SLEEVE ANTENNA YAGI FOR 10/18/24 MHz
45 HIGH
6 ZONES
24.925 MHz
9 WIRES, INCHES

| | | | | | | | |
|---|---|---|---|---|---|---|---|
| 10 | -124.0000 | -294.0000 | 540.0000 | -124.0000 | 294.0000 | 540.0000 | 1.0000 |
| 10 | -123.0000 | -164.0000 | 540.0000 | -120.0000 | 164.0000 | 540.0000 | 1.0000 |
| 10 | -90.0000 | -115.0000 | 540.0000 | -90.0000 | 115.0000 | 540.0000 | 1.0000 |
| 10 | -6.0000 | -139.0000 | 540.0000 | -6.0000 | 159.0000 | 540.0000 | 1.0000 |
| 10 | 0.0000 | -277.0000 | 540.0000 | 0.0000 | 277.0000 | 540.0000 | 1.0000 |
| 10 | 7.0000 | -115.0000 | 540.0000 | 7.0000 | 115.0000 | 540.0000 | 1.0000 |
| 10 | 54.0000 | -115.0000 | 540.0000 | 54.0000 | 115.0000 | 540.0000 | 1.0000 |
| 10 | 57.0000 | -148.0000 | 540.0000 | 57.0000 | 148.0000 | 540.0000 | 1.0000 |
| 10 | 61.0000 | -113.0000 | 540.0000 | 61.0000 | 113.0000 | 540.0000 | 1.0000 |

1 SOURCE
WIRE 5 CENTER

AT 9.0° ELEVATION:

| | | |
|---|---|---|
| 21.250 MHz: | IMPEDANCE | 30.3 - j 0.2 Ω (SWR REFERENCE) |
| | SWR | 1.65 |
| | FORWARD GAIN | 11.33 dBd |
| | F/B | 26.07 dB |
| 21.000 MHz: | IMPEDANCE | 32.0 - j 9.6 Ω |
| | SWR | 1.66 (1.36 WHEN MATCHED AT 21.250 MHz) |
| | FORWARD GAIN | 11.24 dBd |
| | F/B | 18.84 dB |
| 21.500 MHz: | IMPEDANCE | 26.3 + j 10.9 Ω |
| | SWR | 2.03 (1.52 WHEN MATCHED AT 21.250 MHz) |
| | FORWARD GAIN | 11.51 dBd |
| | F/B | 31.11 dB |

AT 10.0° ELEVATION:

| | | |
|---|---|---|
| 18.100 MHz: | IMPEDANCE | 31.0 - j 164.5 Ω (SWR REFERENCE) |
| | SWR | 19.67 |
| | FORWARD GAIN | 3.67 dBd |
| | F/B | -3.44 dB |
| 18.000 MHz: | IMPEDANCE | 31.6 - j 168.8 Ω |
| | SWR | 20.22 (1.18 WHEN MATCHED AT 18.100 MHz) |
| | FORWARD GAIN | 3.81 dBd |
| | F/B | -3.17 dB |
| 18.200 MHz: | IMPEDANCE | 30.3 - j 160.2 Ω |
| | SWR | 19.17 (1.19 WHEN MATCHED AT 18.100 MHz) |
| | FORWARD GAIN | 3.52 dBd |
| | F/B | -3.73 dB |

AT 9.0° ELEVATION:

| | | |
|---|---|---|
| 21.250 MHz: | IMPEDANCE | 52.4 - j 5.3 Ω (SWR REFERENCE) |
| | SWR | 1.12 |
| | FORWARD GAIN | 11.42 dBd |
| | F/B | 29.51 dB |
| 21.000 MHz: | IMPEDANCE | 60.5 - j 6.5 Ω |
| | SWR | 1.25 (1.16 WHEN MATCHED AT 21.250 MHz ) |
| | FORWARD GAIN | 11.30 dBd |
| | F/B | 24.75 dB |
| 21.500 MHz: | IMPEDANCE | 37.8 + j 4.2 Ω |
| | SWR | 1.34 (1.39 WHEN MATCHED AT 21.250 MHz ) |
| | FORWARD GAIN | 11.67 dBd |
| | F/B | 20.07 dB |

A72118C 21/18 MHz DUO-BANDER, 13.41' BOOM
PERFECT GROUND
0 ZONES
21.175 MHz
6 WIRES, INCHES

| | | | | | | | |
|---|---|---|---|---|---|---|---|
| 10 | -72.0000 | -161.0000 | 864.0000 | -72.0000 | 161.0000 | 864.0000 | 0.5574 |
| 10 | -64.0000 | -139.5000 | 864.0000 | -64.0000 | 139.5000 | 864.0000 | 0.7500 |
| -16 | 11.0000 | -131.5000 | 864.0000 | 11.0000 | 131.5000 | 864.0000 | 0.5574 |
| -16 | 17.0000 | -154.0000 | 864.0000 | 17.0000 | 154.0000 | 864.0000 | 0.5574 |
| -16 | 23.0000 | -131.5000 | 864.0000 | 23.0000 | 131.5000 | 864.0000 | 0.5574 |
| 10 | 89.0000 | -125.5000 | 864.0000 | 89.0000 | 125.5000 | 864.0000 | 0.7500 |

1 SOURCE
WIRE 4, CENTER

AT 10.0° ELEVATION:

| | | |
|---|---|---|
| 18.100 MHz: | IMPEDANCE | 54.2 - j 14.2 Ω (SWR REFERENCE) |
| | SWR | 1.33 |
| | FORWARD GAIN | 10.55 dBd |
| | F/B | 10.11 dB |
| 18.000 MHz: | IMPEDANCE | 46.5 - j 14.8 Ω |
| | SWR | 1.37 (1.17 WHEN MATCHED AT 18.100 MHz ) |
| | FORWARD GAIN | 10.65 dBd |
| | F/B | 8.91 dB |
| 18.200 MHz: | IMPEDANCE | 61.0 - j 15.4 Ω |
| | SWR | 1.41 (1.13 WHEN MATCHED AT 18.100 MHz ) |
| | FORWARD GAIN | 10.44 dBd |
| | F/B | 11.21 dB |

AT 9.0° ELEVATION:

| | | |
|---|---|---|
| 21.250 MHz: | IMPEDANCE | 30.3 + j 1.0 Ω (SWR REFERENCE) |
| | SWR | 1.65 |
| | FORWARD GAIN | 14.11 dBd |
| | F/B | 25.33 dB |
| 21.000 MHz: | IMPEDANCE | 28.6 - j 2.8 Ω |
| | SWR | 1.76 (1.15 WHEN MATCHED AT 21.250 MHz ) |
| | FORWARD GAIN | 14.03 dBd |
| | F/B | 25.63 dB |
| 21.500 MHz: | IMPEDANCE | 22.8 + j 3.4 Ω |
| | SWR | 2.21 (1.35 WHEN MATCHED AT 21.250 MHz ) |
| | FORWARD GAIN | 14.14 dBd |
| | F/B | 23.45 dB |

AT 10.0° ELEVATION:

| | | |
|---|---|---|
| 18.100 MHz: | IMPEDANCE | 28.4 - j 153.8 Ω (SWR REFERENCE) |
| | SWR | 18.95 |
| | FORWARD GAIN | 6.96 dBd |
| | F/B | 0.00 dB |
| 18.000 MHz: | IMPEDANCE | 28.7 - j 158.0 Ω |
| | SWR | 19.66 (1.19 WHEN MATCHED AT 18.100 MHz ) |
| | FORWARD GAIN | 6.99 dBd |
| | F/B | 0.14 dB |
| 18.200 MHz: | IMPEDANCE | 28.0 - j 149.6 Ω |
| | SWR | 18.28 (1.20 WHEN MATCHED AT 18.100 MHz ) |
| | FORWARD GAIN | 6.92 dBd |
| | F/B | -0.15 dB |

AT 9.0° ELEVATION:

| | | |
|---|---|---|
| 21.250 MHz: | IMPEDANCE | 49.0 + j 3.0 Ω (SWR REFERENCE) |
| | SWR | 1.07 |
| | FORWARD GAIN | 14.02 dBd |
| | F/B | 22.15 dB |
| 21.000 MHz: | IMPEDANCE | 58.0 - j 12.9 Ω |
| | SWR | 1.32 (1.41 WHEN MATCHED AT 21.250 MHz) |
| | FORWARD GAIN | 13.98 dBd |
| | F/B | 23.07 dB |
| 21.500 MHz: | IMPEDANCE | 53.5 + j 18.2 Ω |
| | SWR | 1.43 (1.36 WHEN MATCHED AT 21.250 MHz) |
| | FORWARD GAIN | 13.99 dBd |
| | F/B | 21.94 dB |

G72118F4.YAG 413.75" BOOM, STAGGERED DR CELL, MOVED FORWARD
PERFECT GROUND
0 ZONES
20.9 MHz
9 WIRES, INCHES

| | | | | | | | |
|---|---|---|---|---|---|---|---|
| 14 | -217.0000 | -162.0000 | 912.000 | -217.0000 | 162.0000 | 912.000 | 1.0000 |
| 14 | -193.0000 | -140.2500 | 912.000 | -193.0000 | 140.2500 | 912.000 | 0.6250 |
| -16 | -136.0000 | -131.0000 | 912.000 | -136.0000 | 131.0000 | 912.000 | 0.6250 |
| -16 | -131.0000 | -155.5000 | 912.000 | -131.0000 | 155.5000 | 912.000 | 1.0000 |
| -16 | -117.0000 | -132.0000 | 912.000 | -117.0000 | 132.0000 | 912.000 | 0.6250 |
| 14 | -63.0000 | -129.0000 | 912.000 | -63.0000 | 129.0000 | 912.000 | 0.6250 |
| 14 | 23.0000 | -126.0000 | 912.000 | 23.0000 | 126.0000 | 912.000 | 0.6250 |
| 14 | 79.2500 | -124.5000 | 912.000 | 79.2500 | 124.5000 | 912.000 | 0.6250 |
| 14 | 196.7500 | -120.7500 | 912.000 | 196.7500 | 120.7500 | 912.000 | 0.6250 |

1 SOURCE
WIRE 4, CENTER

FIG. 13B

AT 10.0° ELEVATION:

| | | |
|---|---|---|
| 18.100 MHz: | IMPEDANCE | 57.3 - j 0.6 Ω (SWR REFERENCE) |
| | SWR | 1.15 |
| | FORWARD GAIN | 12.20 dBd |
| | F/B | 14.75 dB |
| 18.000 MHz: | IMPEDANCE | 50.3 - j 1.0 Ω |
| | SWR | 1.02(1.14 WHEN MATCHED AT 18.100 MHz ) |
| | FORWARD GAIN | 12.23 dBd |
| | F/B | 13.91 dB |
| 18.200 MHz: | IMPEDANCE | 63.7 - j 1.6 Ω |
| | SWR | 1.28(1.11 WHEN MATCHED AT 18.100 MHz ) |
| | FORWARD GAIN | 12.15 dBd |
| | F/B | 15.21 dB |

AT 13.0° ELEVATION:

| | | | |
|---|---|---|---|
| 14.175 MHz: | IMPEDANCE | 31.5 - j 8.7 Ω | (SWR REFERENCE) |
| | SWR | 1.66 | |
| | FORWARD GAIN | 13.50 dBd | |
| | F/B | 27.06 dB | |
| 14.000 MHz: | IMPEDANCE | 32.4 - j 17.0 Ω | |
| | SWR | 1.82 | (1.30 WHEN MATCHED AT 14.175 MHz ) |
| | FORWARD GAIN | 13.37 dBd | |
| | F/B | 25.55 dB | |
| 14.350 MHz: | IMPEDANCE | 26.0 - j 5.4 Ω | |
| | SWR | 1.95 | (1.25 WHEN MATCHED AT 14.175 MHz ) |
| | FORWARD GAIN | 13.47 dBd | |
| | F/B | 22.89 dB | |

```
G7520X3
PERFECT GROUND
0 ZONES
14.15 MHz
5 WIRES, INCHES
24  -262.5000  -212.2500  888.0000  -262.5000  212.2500  888.0000  0.6250
24  -166.2410  -201.0000  888.0000  -166.2410  201.0000  888.0000  0.6250
24   -91.1680  -196.0000  888.0000   -91.1680  196.0000  888.0000  0.6250
24    65.1890  -193.2500  888.0000    65.1890  193.2500  888.0000  0.6250
24   262.5000  -183.2500  888.0000   262.5000  183.2500  888.0000  0.6250
1 SOURCE
WIRE 2, CENTER
```

AT 19.0° ELEVATION:

| | | | |
|---|---|---|---|
| 10.100 MHz: | IMPEDANCE | 23.1 - j 325 Ω | (SWR REFERENCE) |
| | SWR | 93.71 | |
| | FORWARD GAIN | 6.25 dBd | |
| | F/B | 0.67 dB | |
| 10.000 MHz: | IMPEDANCE | 22.3 - j 333 Ω | |
| | SWR | 99.99 (1.69 WHEN MATCHED AT 10.100 MHz ) | |
| | FORWARD GAIN | 6.27 dBd | |
| | F/B | 0.65 dB | |
| 10.200 MHz: | IMPEDANCE | 23.9 - j 316 Ω | |
| | SWR | 86.09 (1.65 WHEN MATCHED AT 10.100 MHz ) | |
| | FORWARD GAIN | 6.23 dBd | |
| | F/B | 0.68 dB | |

AT 13.0° ELEVATION:

| | | |
|---|---|---|
| 14.175 MHz: | IMPEDANCE | 44.1 + j 0.4 Ω (SWR REFERENCE) |
| | SWR | 1.13 |
| | FORWARD GAIN | 13.49 dBd |
| | F/B | 21.72 dB |
| 14.000 MHz: | IMPEDANCE | 52.9 - j 19.7 Ω |
| | SWR | 1.47 (1.57 WHEN MATCHED AT 14.175 MHz) |
| | FORWARD GAIN | 13.34 dBd |
| | F/B | 21.40 dB |
| 14.350 MHz: | IMPEDANCE | 41.6 + j 15.3 Ω |
| | SWR | 1.46 (1.42 WHEN MATCHED AT 14.175 MHz) |
| | FORWARD GAIN | 13.48 dBd |
| | F/B | 19.20 dB |

```
G7520X3A 14/10
PERFECT GROUND
0 ZONES
14.15 MHz
7 WIRES, INCHES
24   -262.5000  -212.2500  888.0000   -262.5000  212.2500  888.0000  0.6250
-16  -171.0000  -202.0000  888.0000   -171.0000  202.0000  888.0000  0.2500
-16  -163.0000  -284.0000  888.0000   -163.0000  284.0000  888.0000  1.0000
-16  -155.0000  -202.0000  888.0000   -155.0000  202.0000  888.0000  0.2500
24    -92.1680  -196.0000  888.0000    -92.1680  196.0000  888.0000  0.6250
24     65.1890  -193.2500  888.0000     65.1890  193.2500  888.0000  0.6250
24    262.5000  -183.2500  888.0000    262.5000  183.2500  888.0000  0.6250
1 SOURCE
WIRE 3, CENTER
```

FIG. 17B

AT 19.0° ELEVATION:

| | | | |
|---|---|---|---|
| 10.100 MHz: | IMPEDANCE | 75.2 - j 10.9 Ω | (SWR REFERENCE) |
| | SWR | 1.56 | |
| | FORWARD GAIN | 6.34 dBd | |
| | F/B | 0.60 dB | |
| 10.000 MHz: | IMPEDANCE | 70.4 - j 17.0 Ω | |
| | SWR | 1.56 | (1.11 WHEN MATCHED AT 10.100 MHz ) |
| | FORWARD GAIN | 6.37 dBd | |
| | F/B | 0.59 dB | |
| 10.200 MHz: | IMPEDANCE | 80.0 - j 5.2 Ω | |
| | SWR | 1.61 | (1.10 WHEN MATCHED AT 10.100 MHz ) |
| | FORWARD GAIN | 6.31 dBd | |
| | F/B | 0.61 dB | |

AT 13.0° ELEVATION:

| | | |
|---|---|---|
| 14.175 MHz: | IMPEDANCE | 42.3 + j 3.7 Ω (SWR REFERENCE) |
| | SWR | 1.20 |
| | FORWARD GAIN | 13.46 dBd |
| | F/B | 21.11 dB |
| 14.000 MHz: | IMPEDANCE | 50.9 - j 16.5 Ω |
| | SWR | 1.39 (1.60 WHEN MATCHED AT 14.175 MHz) |
| | FORWARD GAIN | 13.32 dBd |
| | F/B | 21.46 dB |
| 14.350 MHz: | IMPEDANCE | 39.5 + j 18.4 Ω |
| | SWR | 1.60 (1.44 WHEN MATCHED AT 14.175 MHz) |
| | FORWARD GAIN | 13.46 dBd |
| | F/B | 18.78 dB |

G7520X4A 14/10 W/2EL
PERFECT GROUND
0 ZONES
14.15 MHz
8 WIRES, INCHES

| | | | | | | | |
|---|---|---|---|---|---|---|---|
| 24 | -287.0000 | -297.0000 | 888.0000 | -287.0000 | 297.0000 | 888.0000 | 1.0000 |
| 24 | -264.0000 | -211.0000 | 888.0000 | -264.0000 | 211.0000 | 888.0000 | 0.2500 |
| -16 | -171.0000 | -202.0000 | 888.0000 | -171.0000 | 202.0000 | 888.0000 | 0.2500 |
| -16 | -163.0000 | -277.0000 | 888.0000 | -163.0000 | 277.0000 | 888.0000 | 1.0000 |
| -16 | -155.0000 | -202.0000 | 888.0000 | -155.0000 | 202.0000 | 888.0000 | 0.2500 |
| 24 | -92.1680 | -196.0000 | 888.0000 | -92.1680 | 196.0000 | 888.0000 | 0.6250 |
| 24 | 65.1890 | -193.2500 | 888.0000 | 65.1890 | 193.2500 | 888.0000 | 0.6250 |
| 24 | 262.5000 | -183.2500 | 888.0000 | 262.5000 | 183.2500 | 888.0000 | 0.6250 |

1 SOURCE
WIRE 4, CENTER

FIG. 19B

AT 19.0° ELEVATION:

| | | |
|---|---|---|
| 10.100 MHz: | IMPEDANCE | 37.6 + j 10.4 Ω (SWR REFERENCE) |
| | SWR | 1.45 |
| | FORWARD GAIN | 10.11 dBd |
| | F/B | 11.05 dB |
| 10.000 MHz: | IMPEDANCE | 29.5 - j 1.4 Ω |
| | SWR | 1.70 (1.53 WHEN MATCHED AT 10.100 MHz ) |
| | FORWARD GAIN | 10.33 dBd |
| | F/B | 11.10 dB |
| 10.200 MHz: | IMPEDANCE | 46.7 + j 21.3 Ω |
| | SWR | 1.56 (1.40 WHEN MATCHED AT 10.100 MHz ) |
| | FORWARD GAIN | 9.91 dBd |
| | F/B | 10.73 dB |

AT 30.0° ELEVATION:

| | | | |
|---|---|---|---|
| 10.100 MHz: | IMPEDANCE | 79.2 - j 5.0 Ω | (SWR REFERENCE) |
| | SWR | 1.59 | |
| | FORWARD GAIN | 5.65 dBd | |
| | F/B | 0.00 dB | |
| 10.000 MHz: | IMPEDANCE | 75.9 - j 14.0 Ω | |
| | SWR | 1.61 | (1.13 WHEN MATCHED AT 10.100 MHz ) |
| | FORWARD GAIN | 5.57 dBd | |
| | F/B | 0.00 dB | |
| 10.200 MHz: | IMPEDANCE | 82.7 + j 4.2 Ω | |
| | SWR | 1.66 | (1.13 WHEN MATCHED AT 10.100 MHz ) |
| | FORWARD GAIN | 5.74 dBd | |
| | F/B | 0.00 dB | |

SA3 SLEEVE ANTENNA FOR 10/18/24 MHZ
45' HIGH
0 ZONES
24.900 MHZ
3 WIRES, INCHES

| | | | | | | | |
|---|---|---|---|---|---|---|---|
| -30 | 0.0000 | -158.0000 | 546.0000 | 0.0000 | 158.0000 | 546.0000 | 1.0000 |
| -30 | 0.0000 | -286.0000 | 540.0000 | 0.0000 | 286.0000 | 540.0000 | 1.0000 |
| -30 | 0.0000 | -115.0000 | 533.0000 | 0.0000 | 115.0000 | 533.0000 | 1.0000 |

1 SOURCE
WIRE 2, CENTER

AT 17.0° ELEVATION:

| | | |
|---|---|---|
| 18.100 MHz: | IMPEDANCE | 38.4 + j 17.9 Ω (SWR REFERENCE) |
| | SWR | 1.62 |
| | FORWARD GAIN | 5.32 dBd |
| | F/B | 0.00 dB |
| 18.000 MHz: | IMPEDANCE | 40.5 + j 7.2 Ω |
| | SWR | 1.30 (1.32 WHEN MATCHED AT 18.100 MHz ) |
| | FORWARD GAIN | 5.37 dBd |
| | F/B | 0.00 dB |
| 18.200 MHz: | IMPEDANCE | 36.5 + j 29.0 Ω |
| | SWR | 2.08 (1.35 WHEN MATCHED AT 18.100 MHz ) |
| | FORWARD GAIN | 5.27 dBd |
| | F/B | 0.00 dB |

AT 13.0° ELEVATION:

| | | |
|---|---|---|
| 24.900 MHz: | IMPEDANCE | 61.9 + j 26.7 Ω (SWR REFERENCE) |
| | SWR | 1.68 |
| | FORWARD GAIN | 6.47 dBd |
| | F/B | 0.00 dB |
| 24.800 MHz: | IMPEDANCE | 60.7 + j 10.1 Ω |
| | SWR | 1.31 (1.31 WHEN MATCHED AT 24.900 MHz ) |
| | FORWARD GAIN | 6.71 dBd |
| | F/B | 0.00 dB |
| 25.000 MHz: | IMPEDANCE | 63.6 + j 43.7 Ω |
| | SWR | 2.21 (1.31 WHEN MATCHED AT 24.900 MHz ) |
| | FORWARD GAIN | 6.21 dBd |
| | F/B | 0.00 dB |

AT 30.0° ELEVATION:

| | | |
|---|---|---|
| 10.100 MHz: | IMPEDANCE | 41.2 + j 16.2 Ω (SWR REFERENCE) |
| | SWR | 1.50 |
| | FORWARD GAIN | 9.33 dBd |
| | F/B | 15.78 dB |
| 10.000 MHz: | IMPEDANCE | 31.7 + j 4.3 Ω |
| | SWR | 1.6 (1.53 WHEN MATCHED AT 10.100 MHz ) |
| | FORWARD GAIN | 9.54 dBd |
| | F/B | 17.30 dB |
| 10.200 MHz: | IMPEDANCE | 50.9 + j 26.4 Ω |
| | SWR | 1.68 (1.36 WHEN MATCHED AT 10.100 MHz ) |
| | FORWARD GAIN | 9.14 dBd |
| | F/B | 13.21 dB |

SA3Y3 SLEEVE ANTENNA YAGI FOR 10/18/24 MHz
45' HIGH
0 ZONES
24.925 MHz
9 WIRES, INCHES

| | | | | | | | |
|---|---|---|---|---|---|---|---|
| 10 | -124.0000 | -294.0000 | 540.0000 | -124.0000 | 294.0000 | 540.0000 | 1.0000 |
| 10 | -120.0000 | -164.0000 | 540.0000 | -120.0000 | 164.0000 | 540.0000 | 1.0000 |
| 10 | -90.0000 | -115.0000 | 540.0000 | -90.0000 | 115.0000 | 540.0000 | 1.0000 |
| 10 | -6.0000 | -159.0000 | 540.0000 | -6.0000 | 159.0000 | 540.0000 | 1.0000 |
| 10 | 0.0000 | -277.0000 | 540.0000 | 0.0000 | 277.0000 | 540.0000 | 1.0000 |
| 10 | 7.0000 | -115.0000 | 540.0000 | 7.0000 | 115.0000 | 540.0000 | 1.0000 |
| 10 | 54.0000 | -115.0000 | 540.0000 | 54.0000 | 115.0000 | 540.0000 | 1.0000 |
| 10 | 57.0000 | -148.0000 | 540.0000 | 57.0000 | 148.0000 | 540.0000 | 1.0000 |
| 10 | 61.0000 | -113.0000 | 540.0000 | 61.0000 | 113.0000 | 540.0000 | 1.0000 |

1 SOURCE
WIRE 5, CENTER

FIG. 24B

AT 17.0° ELEVATION:

| | | |
|---|---|---|
| 18.100 MHz: | IMPEDANCE | 39.7 + j 3.7 Ω (SWR REFERENCE) |
| | SWR | 1.28 |
| | FORWARD GAIN | 10.48 dBd |
| | F/B | 34.40 dB |
| 18.000 MHz: | IMPEDANCE | 44.9 + j 4.0 Ω |
| | SWR | 1.15 (1.24 WHEN MATCHED AT 18.100 MHz ) |
| | FORWARD GAIN | 10.44 dBd |
| | F/B | 22.31 dB |
| 18.200 MHz: | IMPEDANCE | 32.5 + j 13.0 Ω |
| | SWR | 1.71 (1.39 WHEN MATCHED AT 18.100 MHz ) |
| | FORWARD GAIN | 10.58 dBd |
| | F/B | 26.53 dB |

AT 13.0° ELEVATION:

| | | |
|---|---|---|
| 24.900 MHz: | IMPEDANCE | 65.1 + j 1.8 Ω (SWR REFERENCE) |
| | SWR | 1.30 |
| | FORWARD GAIN | 10.82 dBd |
| | F/B | 19.42 dB |
| 24.800 MHz: | IMPEDANCE | 61.7 + j 4.5 Ω |
| | SWR | 1.25 (1.12 WHEN MATCHED AT 24.900 MHz ) |
| | FORWARD GAIN | 10.90 dBd |
| | F/B | 16.92 dB |
| 25.000 MHz: | IMPEDANCE | 63.6 + j 4.8 Ω |
| | SWR | 1.29 (1.05 WHEN MATCHED AT 24.900 MHz ) |
| | FORWARD GAIN | 10.78 dBd |
| | F/B | 23.24 dB |

GF2824FX 24' BOOM
PERFECT GROUND
0 ZONES
27.9 MHz
10 WIRES, INCHES

| | | | | | | | |
|---|---|---|---|---|---|---|---|
| 14 | -139.0000 | -188.0000 | 984.0000 | -139.0000 | 188.0000 | 984.0000 | 1.0000 |
| 14 | -132.0000 | -106.0000 | 984.0000 | -132.0000 | 106.0000 | 984.0000 | 0.6250 |
| -16 | -96.0000 | -95.5000 | 984.0000 | -96.0000 | 95.5000 | 984.0000 | 0.6250 |
| -16 | -89.0000 | -112.0000 | 984.0000 | -89.0000 | 112.0000 | 984.0000 | 1.0000 |
| -16 | -82.0000 | -95.5000 | 984.0000 | -82.0000 | 95.5000 | 984.0000 | 0.6250 |
| 14 | -57.0000 | -95.0000 | 984.0000 | -57.0000 | 95.0000 | 984.0000 | 0.6250 |
| 14 | 1.0000 | -91.5000 | 984.0000 | 1.0000 | 91.5000 | 984.0000 | 0.6250 |
| 14 | 55.0000 | -92.5000 | 984.0000 | 55.0000 | 92.5000 | 984.0000 | 0.6250 |
| 14 | 110.0000 | -73.7500 | 984.0000 | 110.0000 | 73.7500 | 984.0000 | 0.6250 |
| 14 | 144.0000 | -87.5000 | 984.0000 | 144.0000 | 87.5000 | 984.0000 | 0.6250 |

1 SOURCE
WIRE 4, CENTER

MONO-TAPER OF MASTER 28/24 MHZ, 24' BOOM

AT 6.0° ELEVATION:

| | | |
|---|---|---|
| 28.800 MHz: | IMPEDANCE | 48.1 + j 6.7 Ω (SWR REFERENCE) |
| | SWR | 1.15 |
| | FORWARD GAIN | 13.84 dBd |
| | F/B | 27.87 dB |
| 27.900 MHz: | IMPEDANCE | 68.8 - j 9.6 Ω |
| | SWR | 1.43(1.58 WHEN MATCHED AT 28.800 MHz ) |
| | FORWARD GAIN | 13.46 dBd |
| | F/B | 18.67 dB |
| 29.700 MHz: | IMPEDANCE | 63.0 - j 14.1Ω |
| | SWR | 1.40(1.58 WHEN MATCHED AT 28.800 MHz ) |
| | FORWARD GAIN | 13.51 dBd |
| | F/B | 15.45 dB |

AT 8.0° ELEVATION:

| | | |
|---|---|---|
| 24.900 MHz: | IMPEDANCE | 44.3 - j 0.5 Ω (SWR REFERENCE) |
| | SWR | 1.13 |
| | FORWARD GAIN | 12.03 dBd |
| | F/B | 13.90 dB |
| 24.800 MHz: | IMPEDANCE | 39.2 - j 1.8 Ω |
| | SWR | 1.28(1.13 WHEN MATCHED AT 24.900 MHz ) |
| | FORWARD GAIN | 12.09 dBd |
| | F/B | 13.74 dB |
| 25.000 MHz: | IMPEDANCE | 49.2 + j 0.0Ω |
| | SWR | 1.02(1.11 WHEN MATCHED AT 24.900 MHz ) |
| | FORWARD GAIN | 11.96 dBd |
| | F/B | 13.88 dB |

FIG. 27.B

NO LOSS, MULTI-BAND, ADAPTABLE ANTENNA

This is a Continuation Application of application Ser. No. 08/557,369, filed Nov. 13, 1995, abandoned, which is a continuation of Ser. No. 08/301,136, filed Sep. 6, 1994 abandoned, which is a continuation of Ser. No. 07/930,191, filed Aug. 12, 1992, now abandoned.

BACKGROUND OF THE INVENTION

1. Field of the Invention

The present invention relates to the field of radio antennas, and in particular to a no-loss, multi-band antenna structure.

2. Background of the Invention

The use of directional antennas for radio communications is well-known in the prior art. Of particular relational interest to this invention is the Yagi-Uda directional design. This type of antenna consists of two or more antenna elements arranged either horizontally or vertically, with all elements in the same plane and parallel to each other. A typical Yagi-Uda antenna is shown in FIG. 1, in which there are four (4) total elements, with the second element 1 from the "Reflector" end 2 (the far right) being the fed (active) element, or "Driver". The elements forward (to the left) of the driver are known as directors, reference numerals 3 and 4 (i.e., Director 1 and 2). The elements not driven directly are known as parasitic elements. This type of antenna can be tuned in various ways to accomplish specific design goals, such as forward gain, front-to-back ratio and operating VSWR (voltage standing wave ratio). Elements can be added, or deleted in the same process. For further information on Yagi-Uda antennas, see, for example, J. L. Lawson, *Yagi Antenna Design* (American Radio Relay League 1986). Multiples of these antennas can also be fed simultaneously in a variety of phase relationships between the individual antennas. The operating frequency of a Yagi-Uda antenna is limited to a few percent of the center design frequency. To enable wider frequency coverage, two methods have been classically employed.

One common method is the use of traps placed in specific locations of the elements. One such antenna is shown in FIG. 2 and is known as a "tri-band" antenna, since it can operate in portions of three distinctive frequency bands (14.0–14.35, 21.0–21.45 and 28.0–29.7 MHz). This type of antenna can be a single element (single dipole), or parasitic elements added in a Yagi-Uda style design. Another common method is the log periodic antenna, in which every element is active, that is, driven directly and not parasitic in nature. It is shown in FIG. 3. This type of antenna can operate over a wide frequency range, limited by the number of elements utilized and the boom length. A range of several megahertz (MHz), such as 14–30 MHz is not uncommon. A hybrid of the log periodic and Yagi-Uda designs is the so-called "log-yag", in which there is a log periodic type driven cell and one or more parasitic elements, as in FIG. 4. Parasitic elements can also be located in various locations within a classic log periodic antenna to augment particular frequency segments within the normal operating range of the log periodic antenna. FIG. 5 is a hybrid multi-band antenna utilizing a two-element log driven cell as well as trapped and non-trapped elements to cover five (5) frequency bands.

The prior art designs described above operate on multiple, as opposed to single, frequency bands only by making substantial sacrifices in performance. Although the multi-element trapped antenna can use fewer elements to cover more frequency ranges, the elements are not spaced optimally, they are not optimally tuned and there are losses associated with the traps. A single trapped dipole also has losses in the traps. Consequently, a Yagi-Uda design with trapped elements represents a compromise design for gain, front-to-back ratio and overall efficiency.

The log-periodic antenna compromises forward gain for wide operating bandwidth. It is believed to exhibit about the same forward gain as a moderately tuned three element Yagi-Uda of short boom length in terms of wavelength, or about 6 dBd. Compared to the usual 3–4% operating bandwidth of a Yagi-Uda, this type can be 25% of the center design frequency.

Another method of realizing wider frequency coverage with an acceptable operating VSWR is the open-sleeve antenna. This is lesser known, although it was invented by Dr. J. T. Bollijahn, of Stanford Research Institute, in about 1946. The typical implementation is shown in FIG. 6, which is the first page from a comprehensive article on the open-sleeve antenna. The antenna consists of three (3) elements: a center element and two "sleeve" elements of equal length and tuned to a higher frequency than the center element, usually at half the frequency. The primary purpose of the open-sleeve antenna is to obtain wider VSWR bandwidth and also operate on two frequencies with a single feedline, as stated in the article.

A commercial utilization of the open-sleeve is contained back in FIG. 2. Here, the open-sleeve is combined with traps to make a three-band driven cell. The center element contains traps and operates on 14 and 21 MHz, whereas the sleeve elements are tuned to 28 MHz. The common driver is the trapped element and the system is fed with a single feedline. The wider bandwidth is achieved when the frequencies of the central and sleeve elements are closely related.

SUMMARY OF THE INVENTION

The present invention permits directional antennas to be constructed to operate over two or more frequency bands with higher forward gain, while utilizing a simple feed system. Unlike the prior art, the invention uses no traps as in the multi-band trapped antennas, thereby inherently being more efficient (no loss in the traps); nor does it employ multiple driven elements as found in the log-periodic antennas, thereby being less complex and less expensive to construct. The invention also enables the antenna to be peaked in forward gain or front-to-back ratio for a particular frequency range, as well as providing the ability to adjust the feed impedance to a variety of resistances without a separate matching system. Furthermore, the invention allows existing single band antennas to be expanded to cover additional frequency bands while maintaining the original performance of the antenna of its design band.

The present invention provides a multi-band Yagi-type antenna comprising a multi-element driven cell having a center element and one or more adjacent elements on each side of the center element. The adjacent elements in the driven cell are electrically shorter than the center element, thereby permitting the driven cell to be tuned to two or more frequency bands. The antenna is fed by a feed line connected to a common feed point at the center of the center element in the driven cell. Parasitic director elements are positioned in front of the driven cell and are tuned to the highest frequency band of the driven cell. Parasitic reflector elements for one or more frequency bands are positioned behind the driven cell, with these elements tuned to actual operating frequencies of the antenna. If more than one reflector is used, the lower frequency reflectors are placed relatively farther away from the driven cell with respect to the higher frequency reflectors.

The invention also provides a multi-band dipole antenna array covering three or more frequency bands comprising a set of dipole elements having a center element and one or more adjacent elements on each side of the center element. The adjacent elements are electrically shorter than the center element and are of unequal lengths. The antenna is fed by a feed line connected to a common feed point at the center of the center element of the set of dipole elements. Parasitic director elements are positioned in front of the set of dipole elements, and parasitic reflector elements are positioned behind the set of dipole elements.

BRIEF DESCRIPTION OF THE DRAWINGS

The objects, features and advantages of the present invention will be apparent from the following detailed description in which:

FIG. 13B illustrates the physical dimensions of elements and spacings for the antenna of FIG. 13A.

FIG. 17B illustrates the physical dimensions of the elements and spacings for the antenna of FIG. 17A.

FIG. 19B illustrates the physical dimensions of the elements and spacings for the antenna of FIG. 19A.

FIG. 24B illustrates the physical dimensions of the elements and spacings for the antenna of FIG. 24A.

FIG. 27B illustrates the antenna of FIG. 27A operating at 27.9–29.7 MHz and 24.8–25.0 MHz

DETAILED DESCRIPTION OF THE INVENTION

The present invention provides an innovative antenna design for multi-band Yagi-style antennas. A Yagi-style antenna using an open sleeve type driven cell and one or more parasitic elements (including parasitic directors of an open sleeve type design for more than one frequency band) is described. The invention also provides an improved open sleeve antenna comprising a set of dipoles that cover more than the two frequency bands provided by prior art open sleeve antennas. The antennas of the present invention provide operation over a wide frequency range without sacrificing gain or using traps, which contribute to losses in the antenna. In the following description, detailed dimensions are provided to enable construction of antennas embodying the invention to provide a thorough understanding of the present invention. However, it will be apparent to one skilled in the art that the invention may be practiced without these details and that the invention may be expanded to operate at more frequency bands than those described herein. Moreover, well-known elements, devices and the like are not set forth in detail in order to avoid unnecessarily obscuring the present invention.

Figure 1:
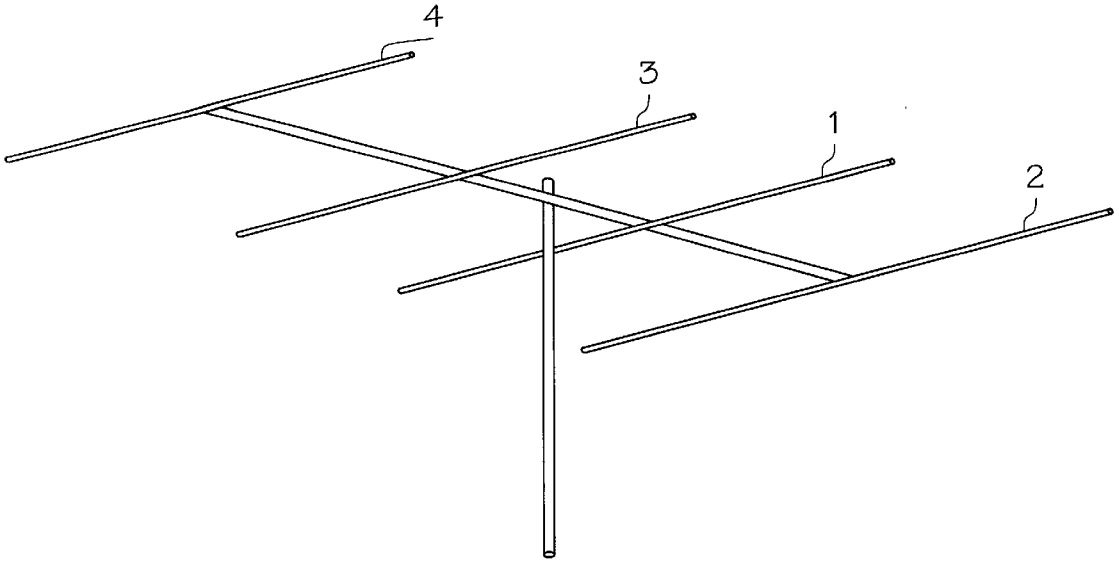
FIG. 1 PRIOR ART
FIG. 1 illustrates a prior art basic Yagi-Uda antenna.
Figure 2:
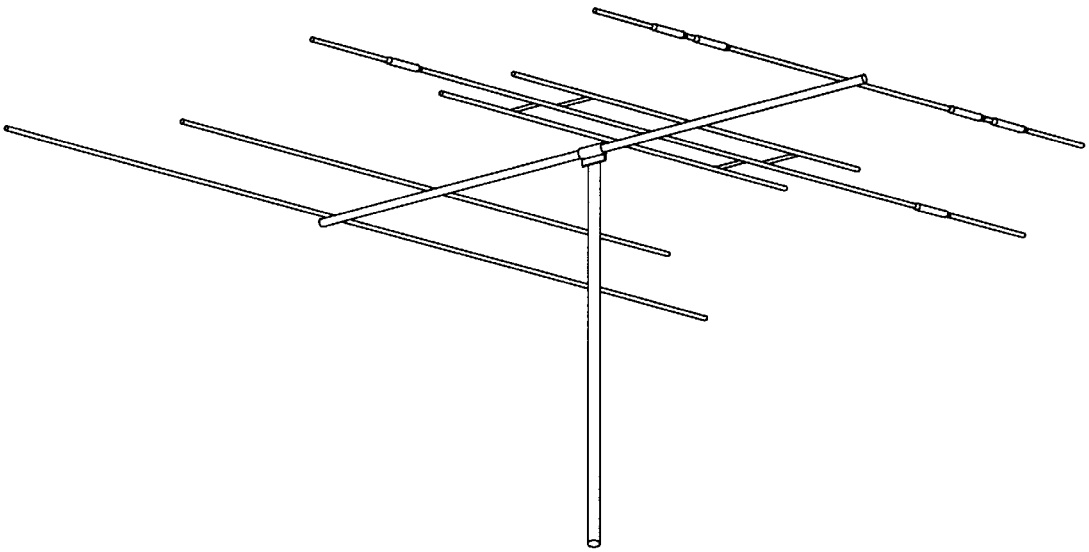
FIG. 2 PRIOR ART
FIG. 2 illustrates a commercially available prior art three band antenna.
Figure 3:
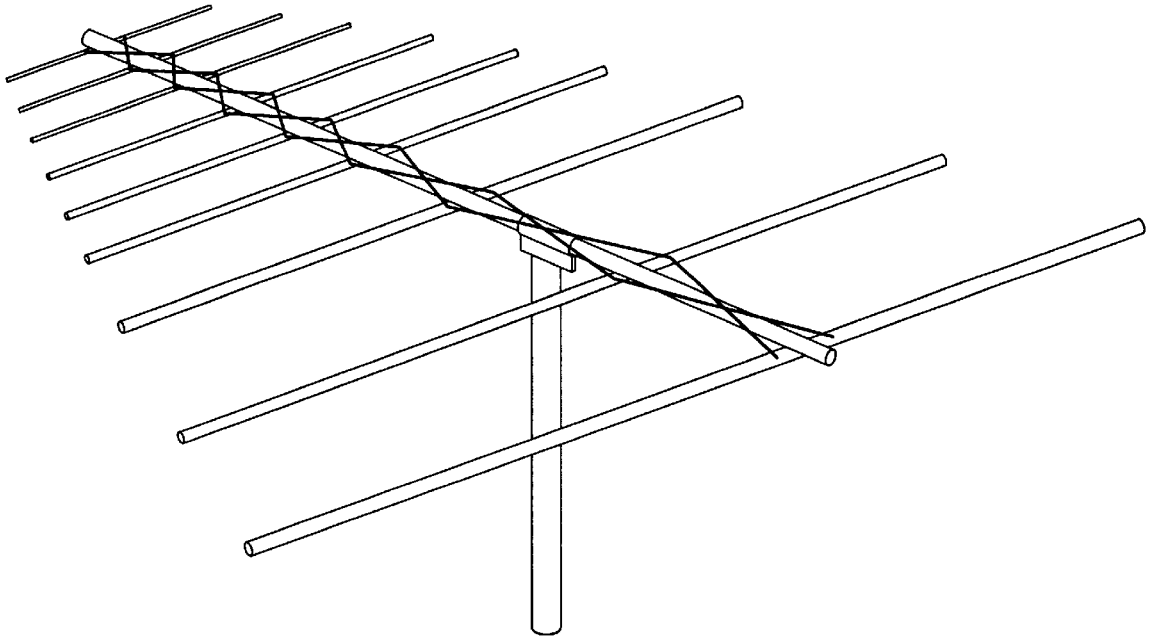
FIG. 3 PRIOR ART
FIG. 3 illustrates a commercially available prior art log-periodic antenna.
Figure 4:
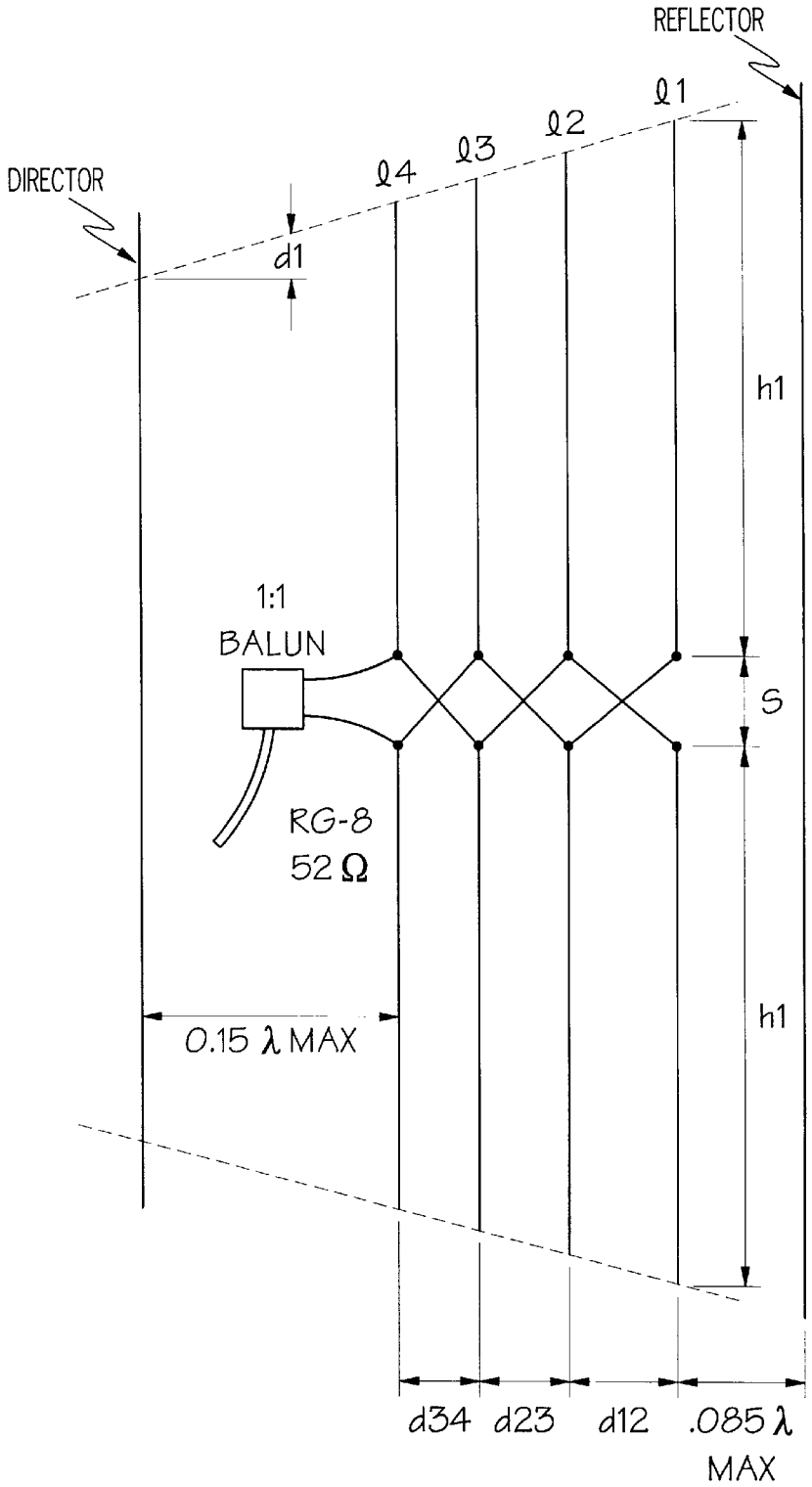
FIG. 4 PRIOR ART
FIG. 4 illustrates a prior art Log-Yag array.
Figure 5:
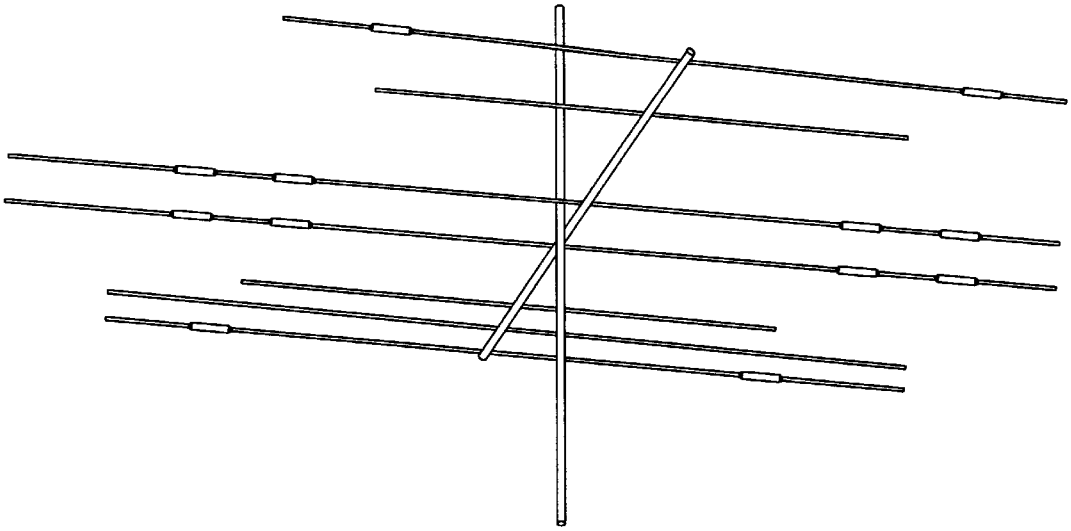
FIG. 5 PRIOR ART
FIG. 5 illustrates a prior art five band antenna.
Figure 6:
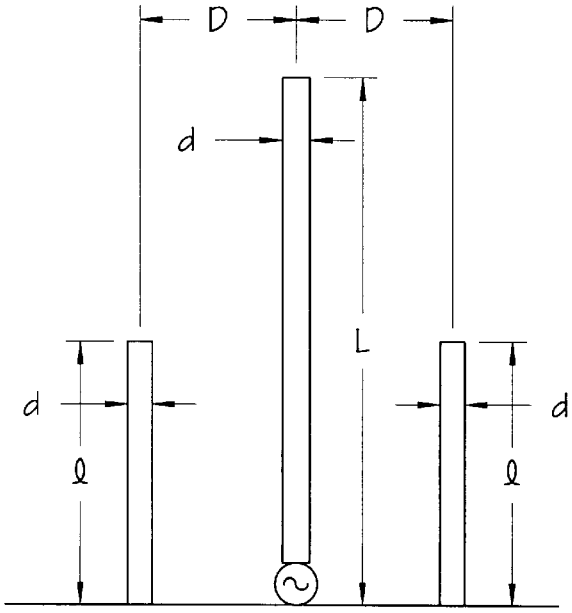
FIG. 6 PRIOR ART
FIG. 6 illustrates a prior art Open-Sleeve antenna.
Figure 7:
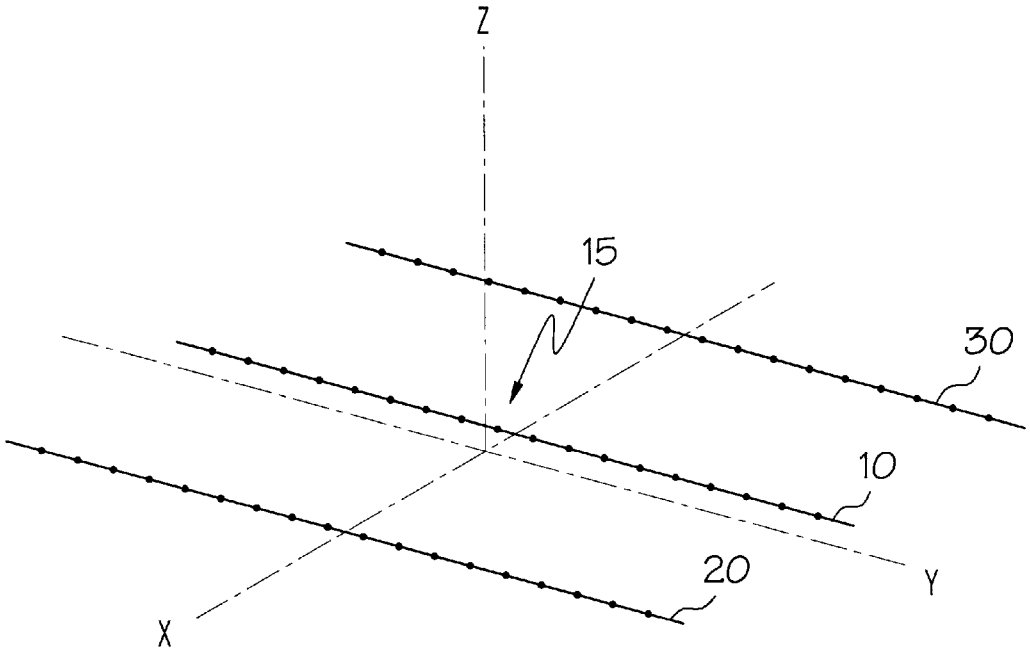
FIG. 7 PRIOR ART
FIG. 7 illustrates a prior art 3 element 21 MHz Yagi.

Referring to FIG. 7, the antenna displayed is a conventional three (3) element Yagi type analyzed at 21.200 MHz and is identified as "G731512". This is a common design and is known by those skilled in the art and is shown over real, perfect ground. The center element is the driver and its center is the feed point for the array. The element to the right (towards the "rear") is the parasitic reflector ("reflector") and the element to the left of the driver (towards the "front") is the parasitic director. Each element is set to a particular length and the spacing between elements is also set to provide the specified performance. As can be seen, the antenna exhibits reasonable gain figures, as well as pattern.

Figure 8:
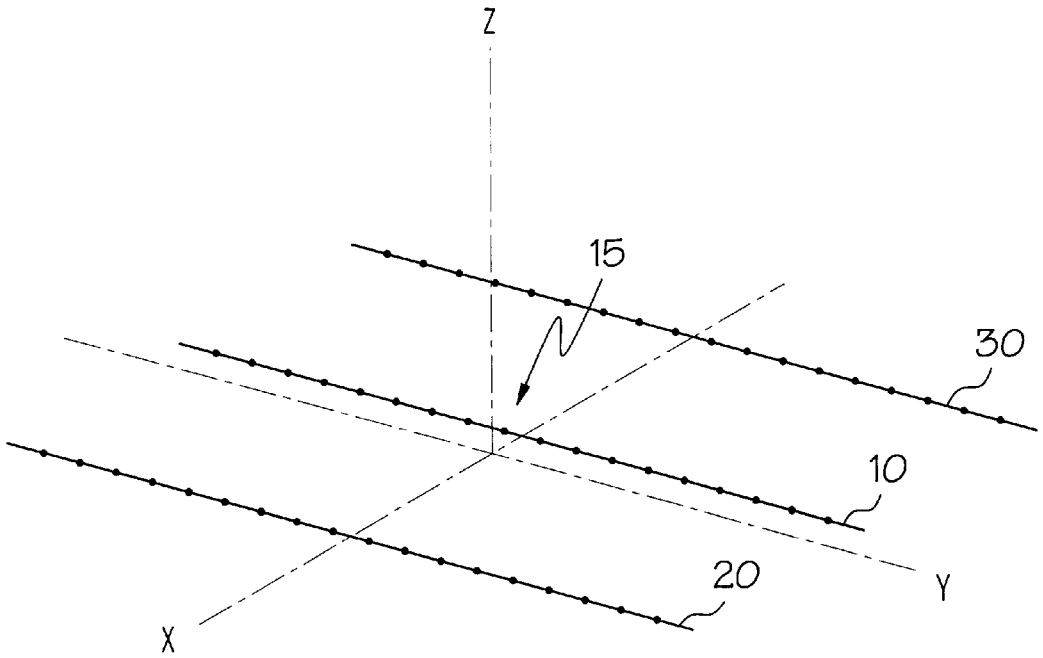
FIG. 8 PRIOR ART
FIG. 8 illustrates the antenna of FIG. 7 operating at 18.1 MHz.

It can be matched to 50 ohms and the VSWR over the specified frequency range is provided in the parenthetical comments. When the antenna is operated at 18 MHz, however, the response is much less favorable as shown in FIG. 8. The feed point is highly reactive and it will be appreciated by those skilled in the art that the use of a common feed point for both frequency ranges in this design is not reasonable. However, even if a feed system were achieved, the gain and pattern on the 18 MHz range are not generally accepted as desirable. Utilizing the present invention, however, this antenna can be made to operate well on both frequency ranges and retain a common feed point.

Figures 9A, 9B:
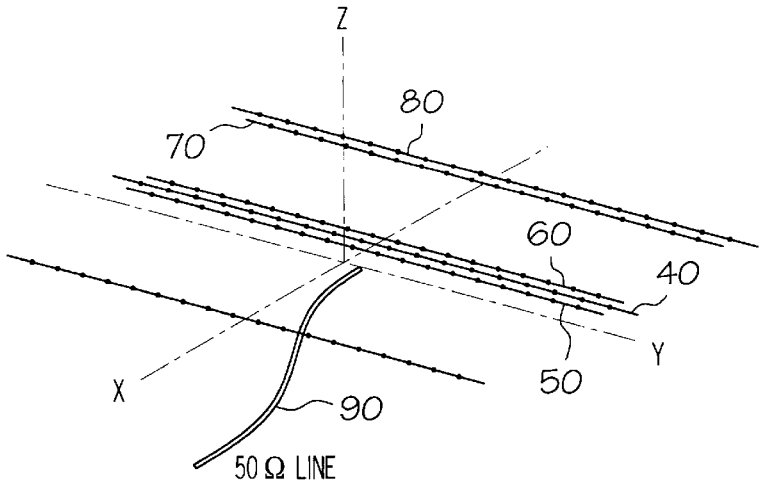
FIG. 9A illustrates a 18/21 MHz dual band antenna of the present invention.
FIG. 9B illustrates the physical dimensions of the elements and spacings for the antenna of FIG. 9.
Figure 10:
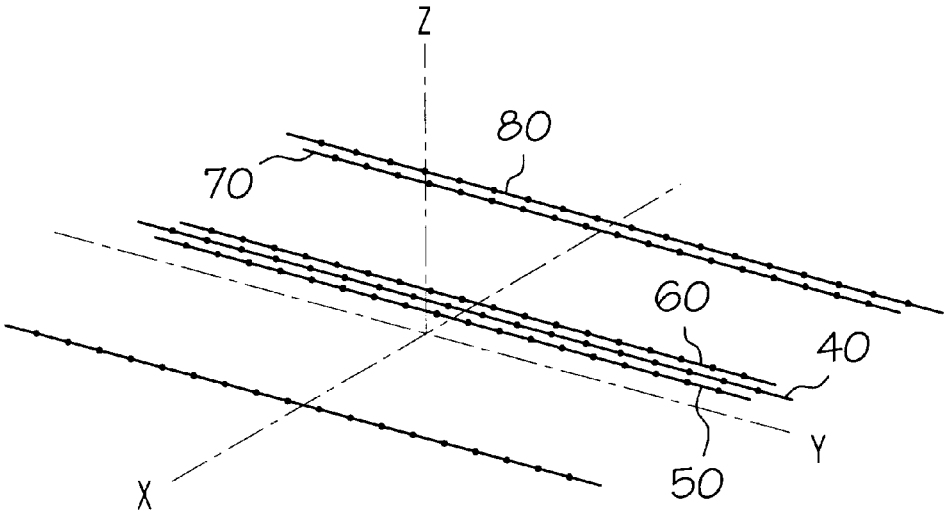
FIG. 10 illustrates the present invention of FIG. 9A operating at 18.1 MHz.

As shown in FIGS. 9 and 10, the present invention replaces the single element driver (e.g. 10 in FIG. 7) with an open-sleeve driven cell which includes element 40 tuned to 18 MHz and 21 MHz, and elements 50 and 60 adds a parasitic reflector 80 for 18 MHz behind the 21 MHz 70 reflector. Without the addition the 18 MHz parasitic reflector 80 the antenna would exhibit a problem found in the prior art, namely that the 21 MHz reflector 70 will act as a director when the driven cell is operating at 18 MHz because the 21 MHz reflector is close in frequency to an optimal 18 MHz director. The present invention cures the problem found in the prior art through the addition of the 18 MHz reflector. The forward gain of this new configuration in the 21.0 to 21.5 MHz range is actually increased slightly, while the front-to-back ratio is shifted down slightly in frequency. This variation is due to the location of the driven cell versus the single driver, but is quite acceptable. With slight relocation of element(s) (e.g. 40, 50, 60, 70, 80) and slight adjustments in element length(s), the front-to-back ratio can be restored as before the open-sleeve driver was included. The VSWR over the same range has broadened. The input impedance has been increased to a nominal value of 50 ohms, suitable for direct feed without a matching system. The performance on 18 MHz has improved substantially. At the center frequency of 18.1 MHz, the forward gain has increased from 3.67 dBd to 10.55 dBd and the front-to-back has improved from −3.44 dB to 10.11 dB. Simultaneously, the feed point impedance has been made useful at a nominal value of 50 ohms. This two-band antenna now can be fed with a single 50 ohm line 90 and no matching network. According to the invention, a single-band, Yagi antenna has now been improved to cover two frequency bands without the use of traps in elements and without the use of log-periodic driven systems, while retaining the original performance on the original band, providing good performance on the added band and enabling the use of a common driver (40 in FIG. 9) that can be fed directly without any matching network.

Further improvement on the original frequency band by lengthening the antenna and adding directors will also improve the forward gain on the added band. In an alternate embodiment, directors are added (boom length increased) to the present invention for the higher frequency band, which has a positive effect on the forward gain of the added band (which is the lower frequency here). The use of directors tuned to the higher frequency band as directors for lower frequency bands is contrary to the teachings of the prior art. The prior art instructs that directors must be close to the design frequency of an antenna to be effective. Thus, according to the prior art, a 21 MHz director would not render an acceptable performance as a director for an 18 MHz driver. However, the present invention, utilizing the novel feature of directors tuned to the higher frequency band, renders superior performance over the prior art, as illustrated in the following example.

Figure 11:
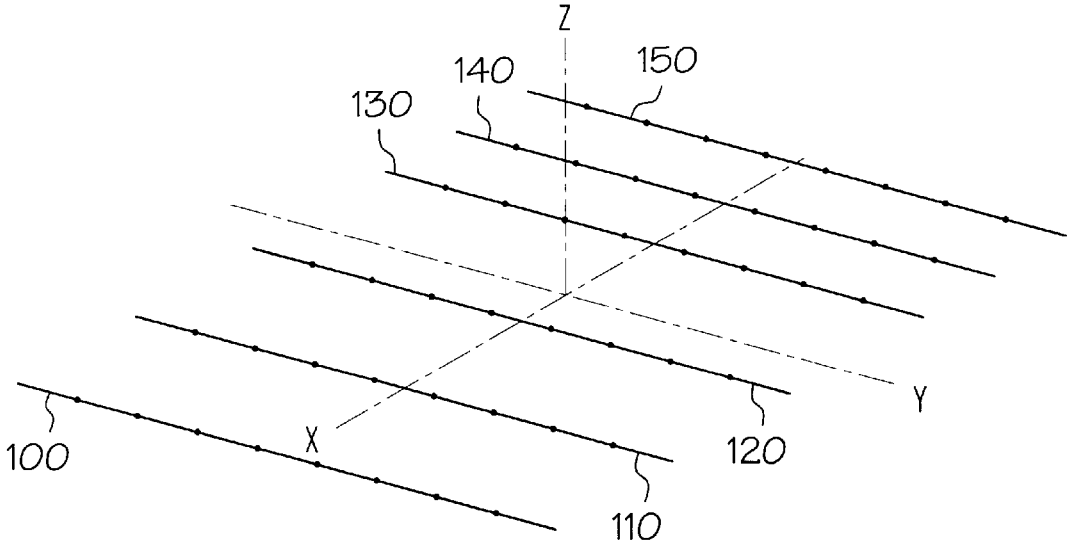
FIG. 11 PRIOR ART
FIG. 11 illustrates a prior art 6 element 21 MHz Yagi.
Figure 12:
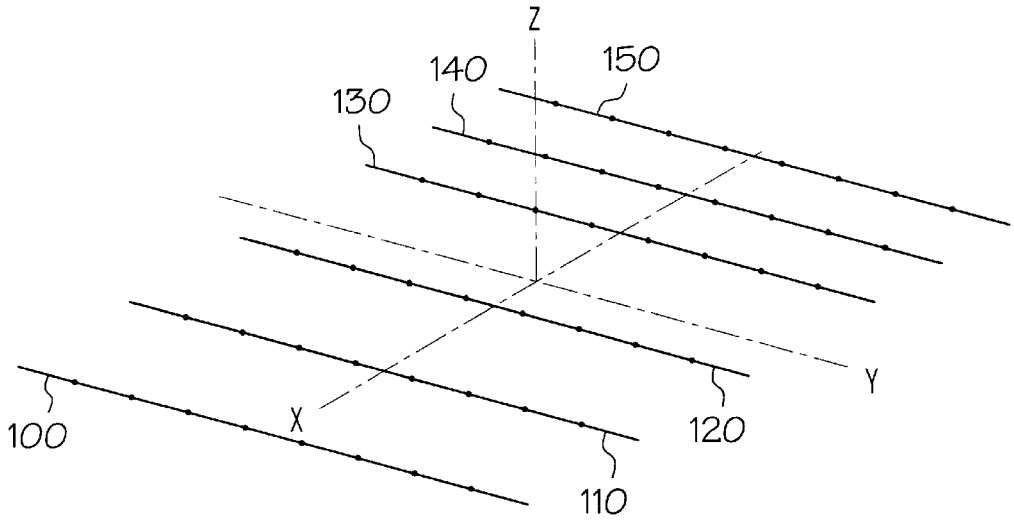
FIG. 12 PRIOR ART
FIG. 12 illustrates the antenna of FIG. 11 operating at 18.1 MHz.
Figure 13A:
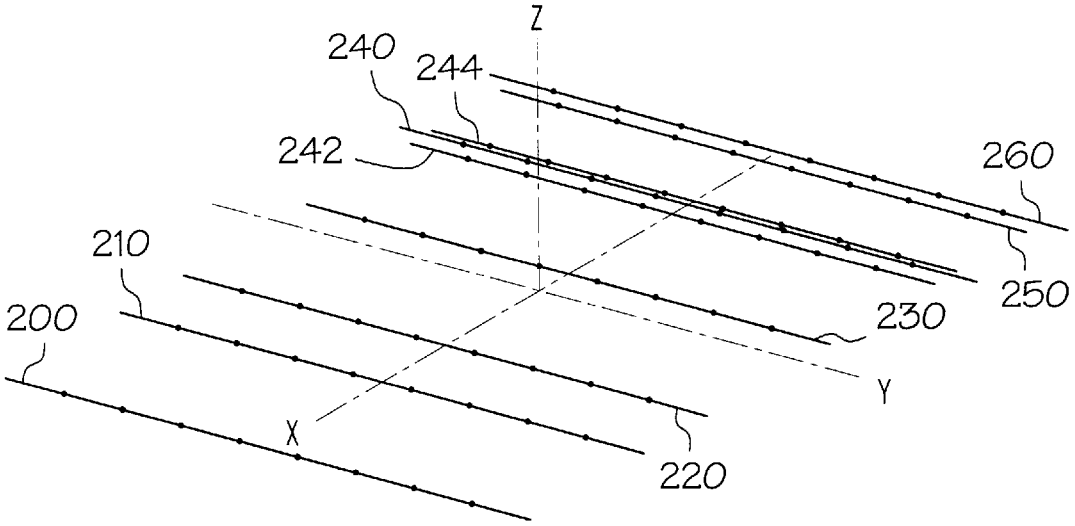
FIG. 13A illustrates an antenna of the present invention operating at 21 MHz.
Figure 14:
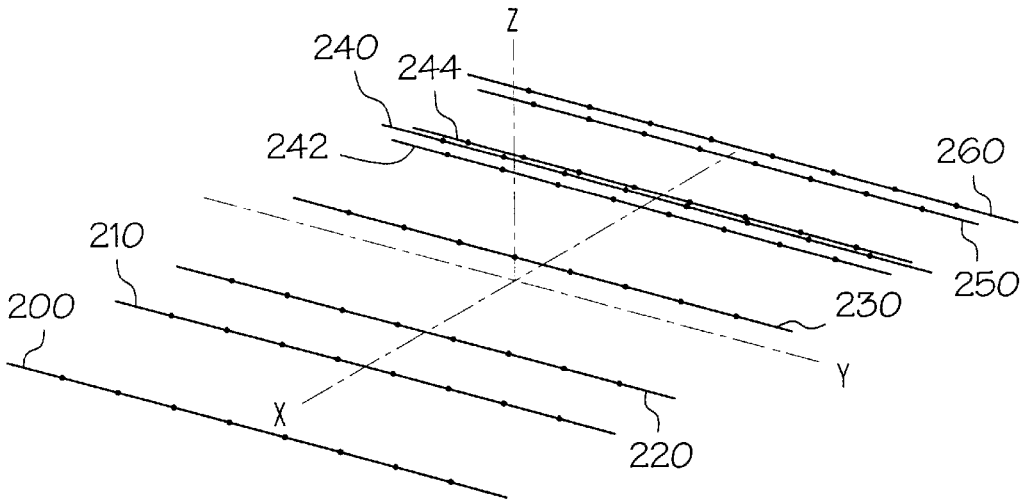
FIG. 14 illustrates the antenna of FIG. 13A operating at 18.1 MHz.

FIG. 11 is a 6 element prior art Yagi antenna (noted as "G761533A") for the same frequency band as the original example (FIG. 7). The boom length has been lengthened from 12' to 33' and the total elements increased from three (3) to six (6). The improvement at the center of the design band is 14.11 dBd over perfect ground, as compared to 11.33 dBd for the shorter antenna. FIG. 12 is the analysis of the antenna of FIG. 11 on 18.0–18.2 MHz. It is highly reactive, and exhibits 6.96 dBd forward gain at 18.1 MHz, which is only a 3.3 dB improvement over the shorter antenna (as shown in FIG. 8). The antenna of FIG. 11 is now improved for operation on two bands by the implementation of the present invention. The antenna of FIG. 11 is comprised of elements 100, 110, 120, 130, 140, 150, with the driver element being 140. Referring to FIG. 13, the elements of FIG. 11 are respectively shown as 200, 210, 220, 230, 240, 250. The single driver 240 is now expanded into an open sleeve driver cell of center driver 240 and adjacent drivers 242 and 244. An additional reflector 260 is also added. FIGS. 13 and 14 show the antenna according to the present invention operating at the same two frequencies. The forward gain has been retained within less than 0.1 dB on the original design frequency and the additional band of 18.0–18.2 MHz has been greatly improved to 12.20 dBd, plus an improved front-to-back ratio of 14.75 dB, as shown in FIG. 14. The present invention thus results in a design that covers two frequency bands with fine performance and that is able to be fed directly without a matching network.

Figures 15A, 15B:
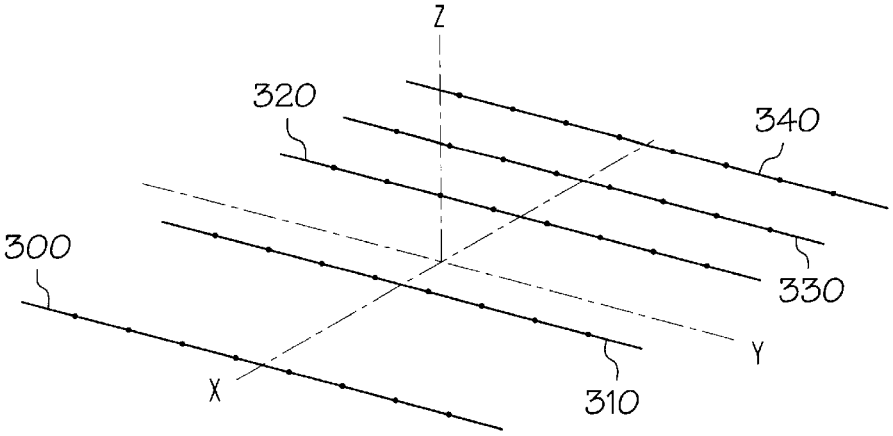
FIG. 15A PRIOR ART
FIG. 15B PRIOR ART
FIG. 15A illustrates a prior art 5 element Yagi operating at 14 MHz.
FIG. 15B illustrates the physical dimensions of the elements and spacings for the antenna of FIG. 15A.
Figure 16:
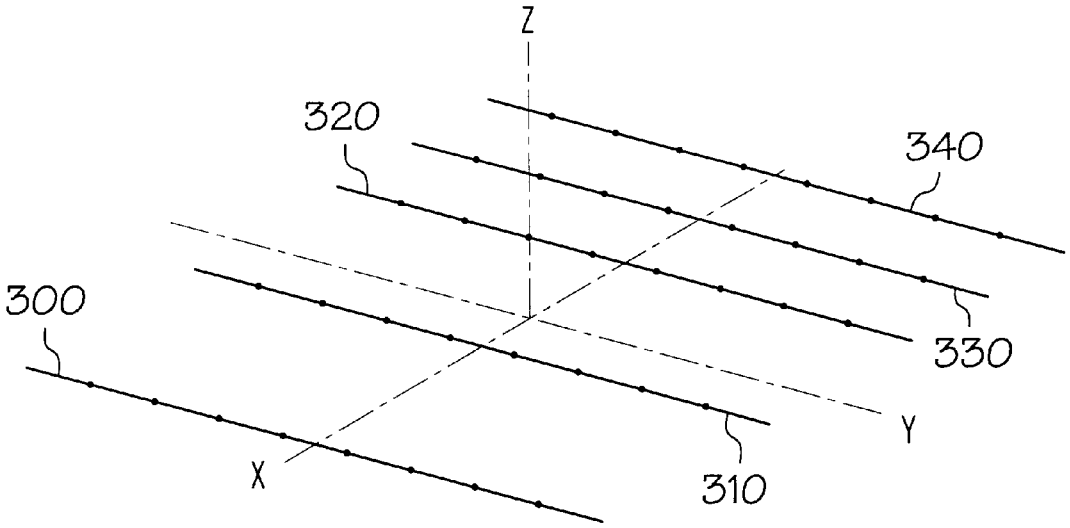
FIG. 16 PRIOR ART
FIG. 16 illustrates the antenna of FIG. 15A operating at 10.1 MHz.

The above implementations are for two frequency bands about 14% apart; the original band being 21 MHz and the added band being 14% lower, 18 MHz. The present invention is also useful for larger differences in frequency ranges. FIG. 15 illustrates a prior art antenna for 14.0–14.35 MHz with 5 elements and a boom length of 40 feet. FIG. 16 is the same prior art antenna driven at 10.1 MHz, or 28% lower in frequency (twice that of the prior example). Although the antenna has 6.25 dBd forward gain at 10.1 MHz, it is very reactive and a common feed for both bands is not reasonable. It should be noted that a tuner at the transmitting end of the feedline could be included to match such a reactive load, thereby presenting an acceptable match to the transmitter (and receiver). However, it is known by those skilled in the art that a high VSWR (approximately 90:1 in this case), will cause high losses in the feedline, even failure if the line cannot handle the high voltages that will be present due to the line-to-antenna mismatch.

Figure 17A:
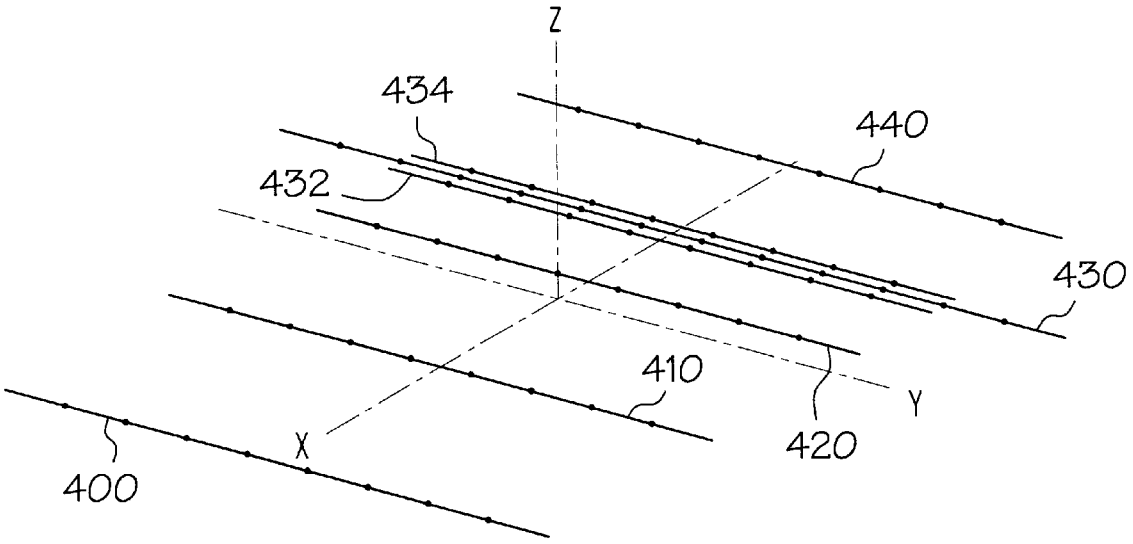
FIG. 17A illustrates an antenna of the present invention operating at 14 MHz.
Figure 18:
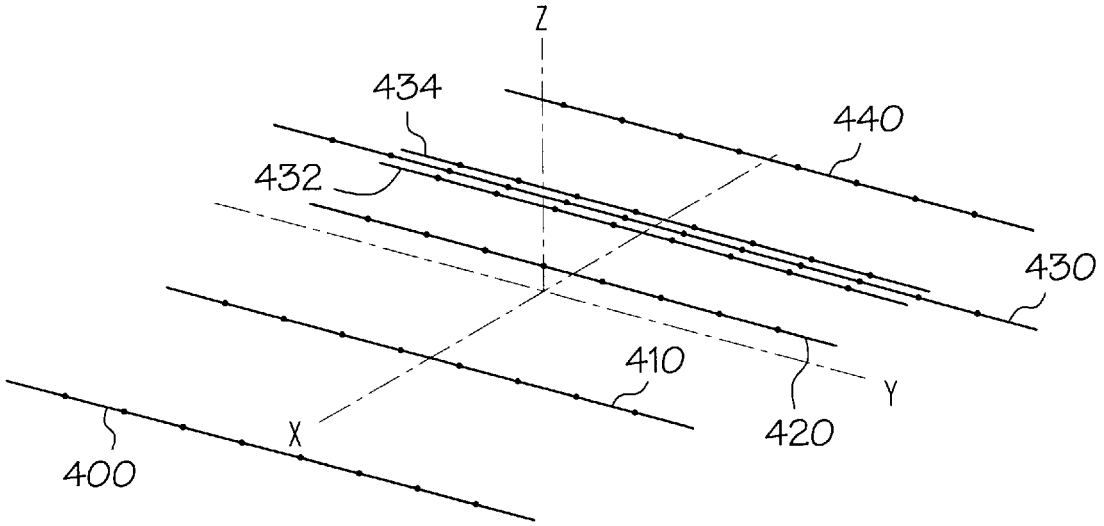
FIG. 18 illustrates the antenna of FIG. 17A operating at 10.1 MHz.
Figure 19A:
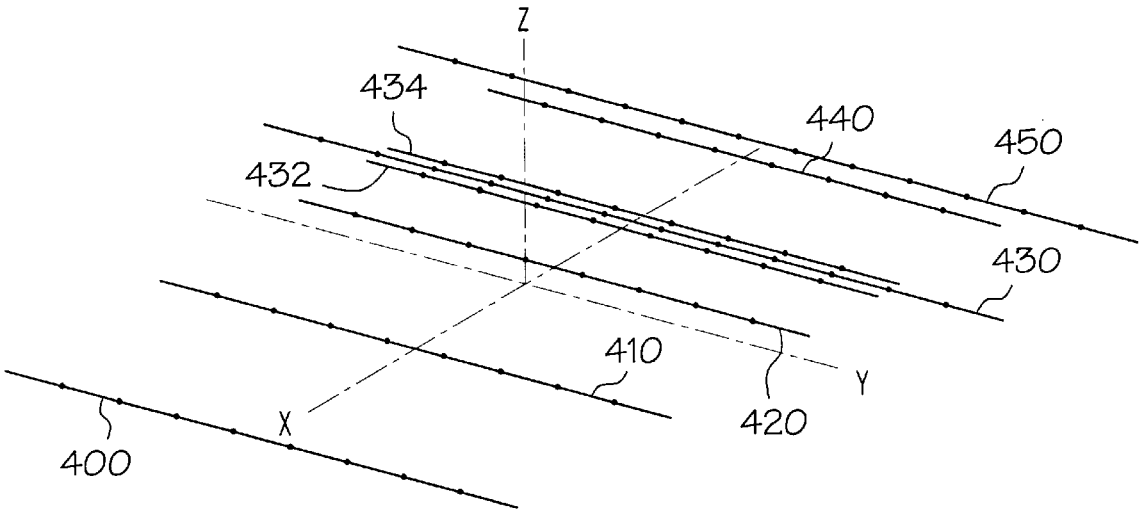
FIG. 19A illustrates another embodiment of the antenna of the present invention.

An embodiment of the present invention incorporating an open-sleeve driven cell, as an improvement over the prior art antennas of FIGS. 15 and 16, is shown in FIG. 17. Elements 300, 310, 320, 330, 340 of the prior art antenna of FIG. 15 are respectively shown in FIG. 17 as 400, 410, 420, 430, 440. The single driver element 430 has been expanded according to the present invention to include adjacent driver elements 432 and 434. As before, unlike the prior art, the invention retains the original performance on the original design frequency. FIG. 18 shows that the antenna can now be fed with a common feed line for both bands, 14 and 10 MHz. The antenna now has an acceptable input impedance and can be driven with a common feedline for both frequency bands. There is also a slight front-to-back ratio at 10.1 MHz, indicating the effect of the 14 MHz directors.

Figure 20:
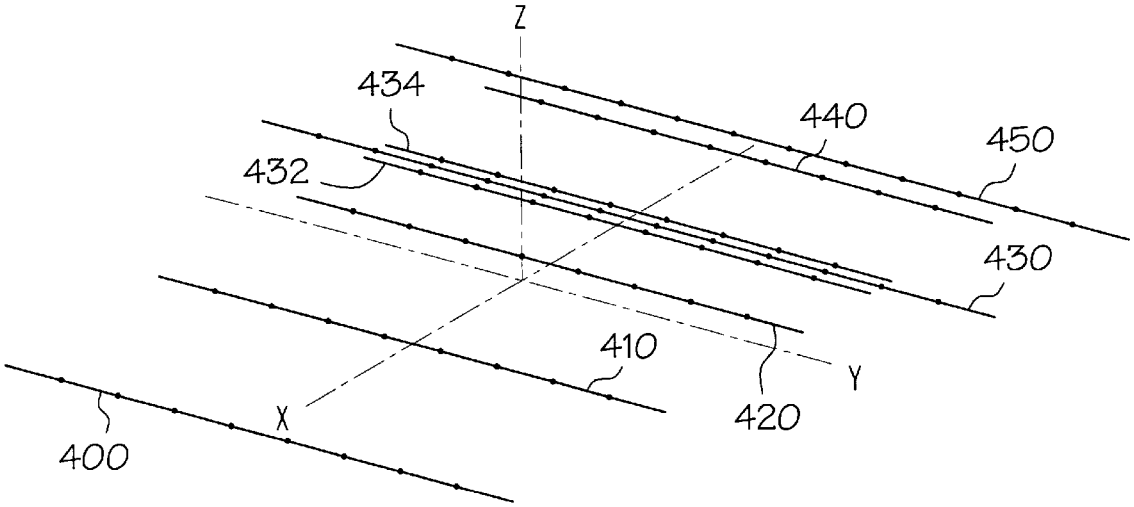
FIG. 20 illustrates the antenna of FIG. 19A operating at 10.1 MHz.

Another embodiment of the invention incorporates a reflector. As shown in FIG. 17, a reflector element 450 for 10 MHz has been added. Again, the performance on the original frequency band (14 MHz) is retained. The performance on 10 MHz, however, has been significantly enhanced, as can be seen in FIG. 20. The antenna now is very useful over two frequency bands 28% apart, can be fed with a single feedline and does not require a matching network, nor are there any losses due to traps.

Figures 21A, 21B:
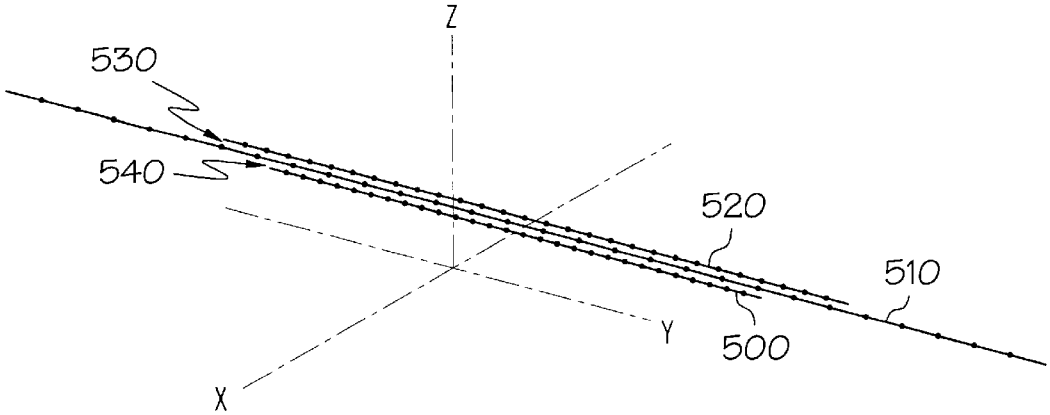
FIG. 21A illustrates an antenna of the present invention comprising a set of dipoles for three frequency bands operating at 10.1 MHz.
FIG. 21B illustrates the physical dimensions of the elements and spacings for the antenna of FIG. 21A.
Figure 22:
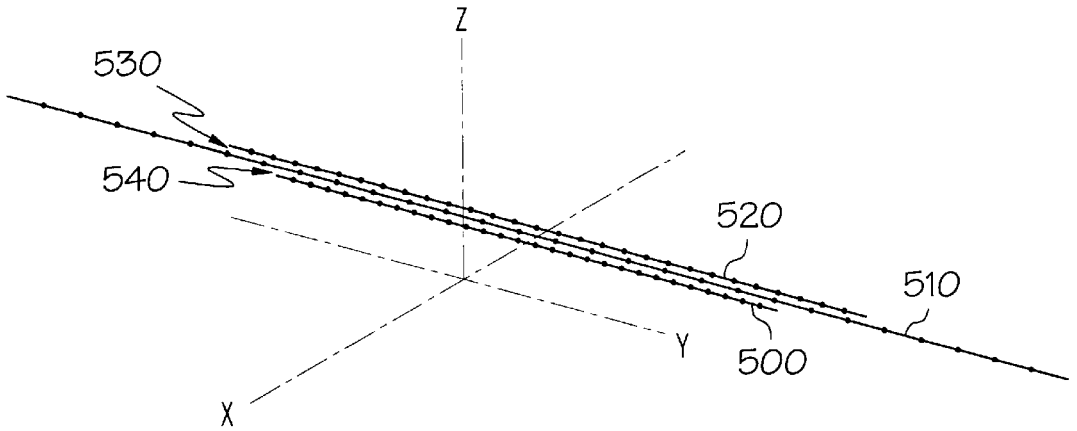
FIG. 22 illustrates the antenna of FIG. 21A operating at 18.1 MHz.
Figure 23:
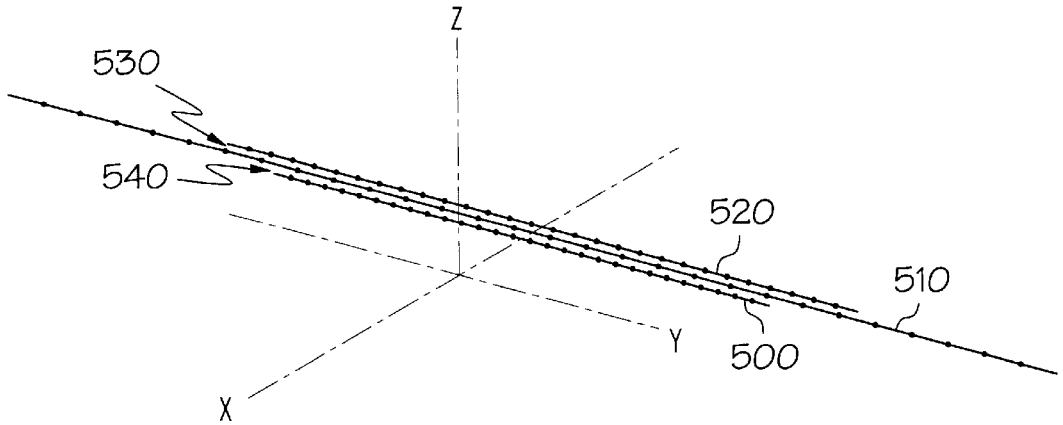
FIG. 23 illustrates the antenna of FIG. 21A operating at 24.9 MHz.

Another embodiment of the present invention allows coverage of more than two frequency bands and allows the addition of parasitic directors tuned to more than one frequency band. The conventional open sleeve antenna provides only two-band coverage, using sleeve elements of equal lengths. The present invention improves upon the original open-sleeve design and expands it to include more than two band coverage. An improved open-sleeve antenna for three (3) bands, 10.1, 18.1 and 24.9 MHz, is shown in FIG. 21, FIG. 22 and FIG. 23 in the form of a multi-band dipole array. The antenna is comprised of a set of dipoles containing three (3) elements 510: the center element, which is tuned at the lowest frequency (10.1 MHz); and two outside or sleeve elements 500 and 520, that are tuned to two higher frequencies. The sleeve elements 500 and 520 are appropriately spaced from the center element 510. The spacing 530 and 540 between the individual elements in the set of dipoles and the electrical lengths of each dipole (500, 510, 520) are adjusted for the desired feedpoint impedance. The spacings need not be equal. The lengths will normally not be equal. As can be seen, the classic open-sleeve antenna has been improved for three (3) band coverage, while maintaining a single feedline and no matching network. Additional elements can be added to the center elements of the set of dipoles to attain operation on more than three bands, with spacings and lengths appropriately adjusted (in a similar manner as above) for the desired feed point impedance of the antenna.

Figure 24A:
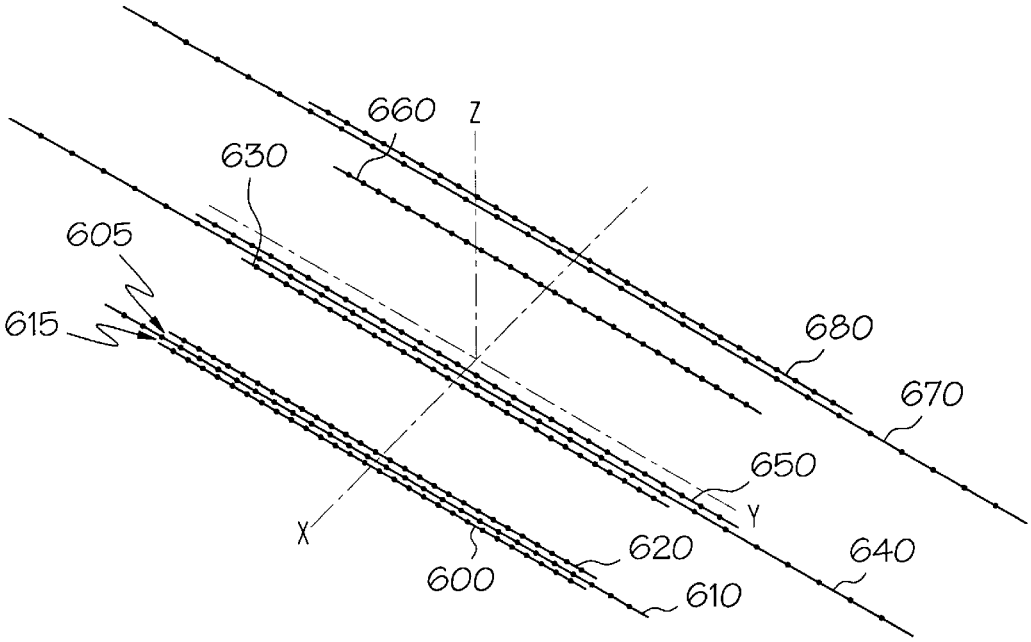
FIG. 24A illustrates an embodiment of the present invention comprising a three band Yagi-style antenna operating at 10.1 MHz.
Figure 25:
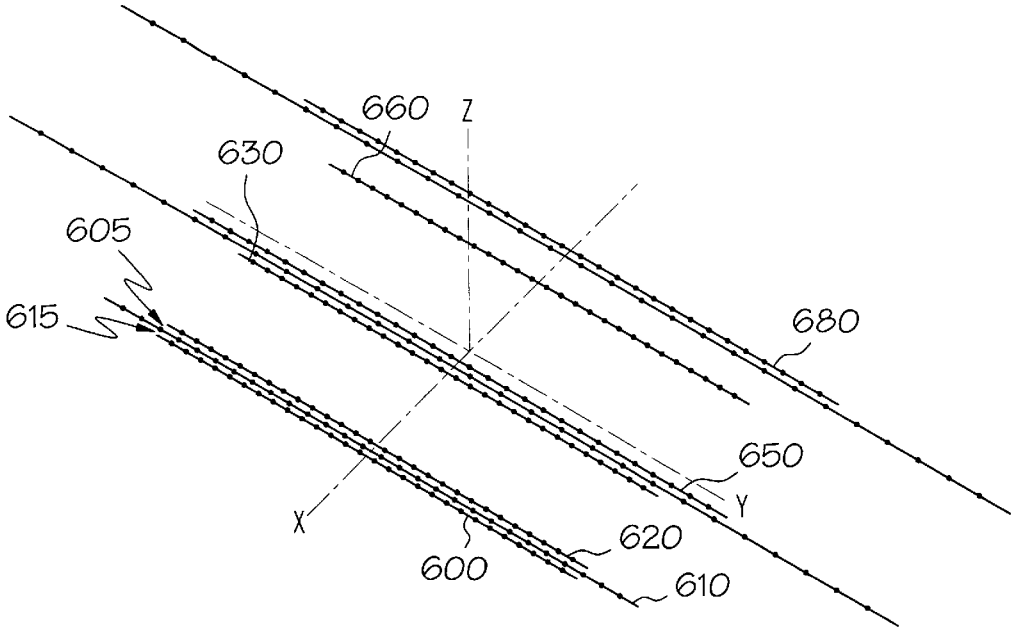
FIG. 25 illustrates the antenna of FIG. 24A operating at 18.1 MHz.
Figure 26:
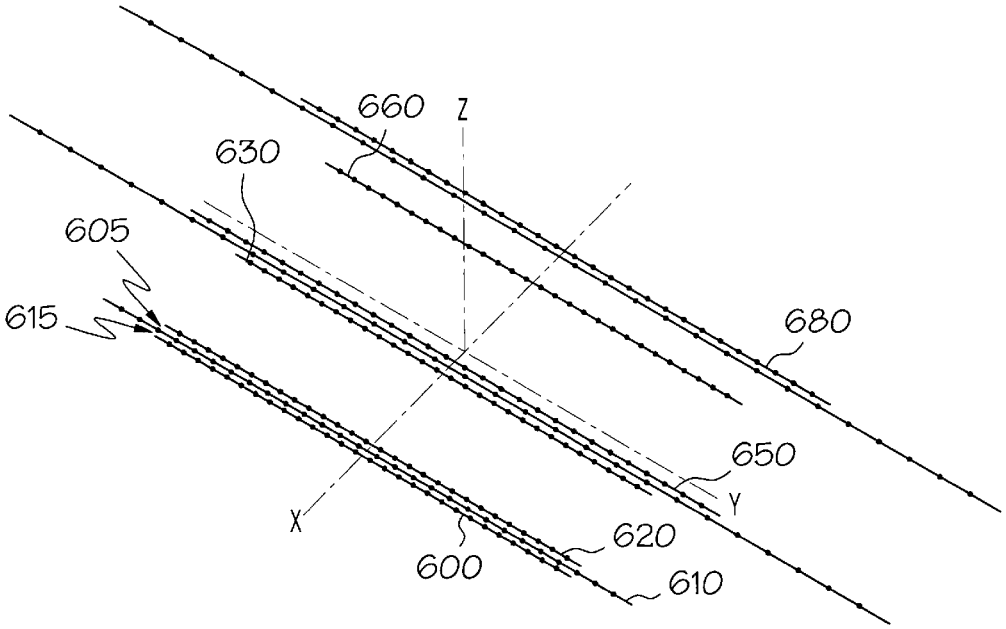
FIG. 26 illustrates the antenna of FIG. 24A operating at 24.9 MHz.
Figure 27A:
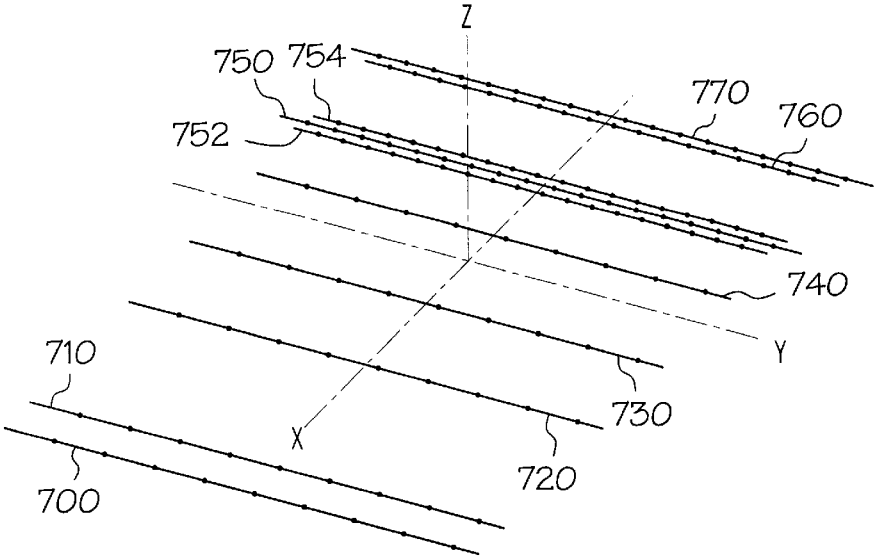
FIG. 27A illustrates an embodiment of the present invention implemented as a 24/28 MHz Dual-band Yagi-style
Figure 27C:
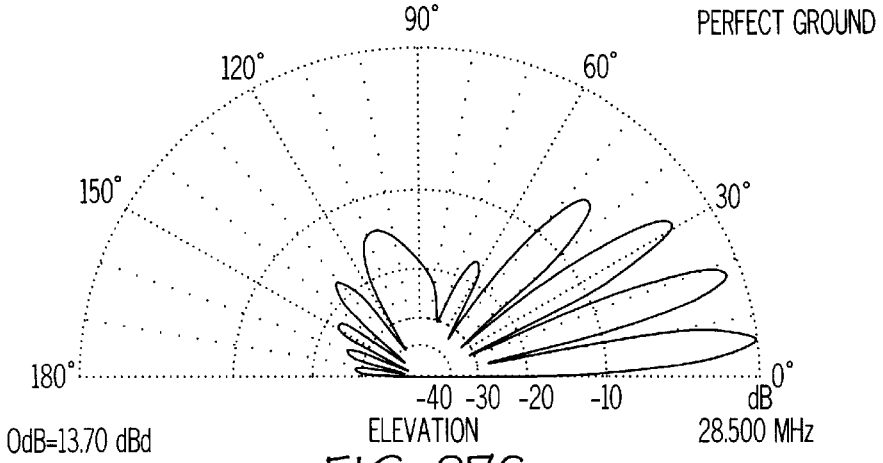
FIG. 27C and 27D illustrates radiation patterns for the antenna of FIG. 27A operating at 28.5 MHz.
Figure 27D:
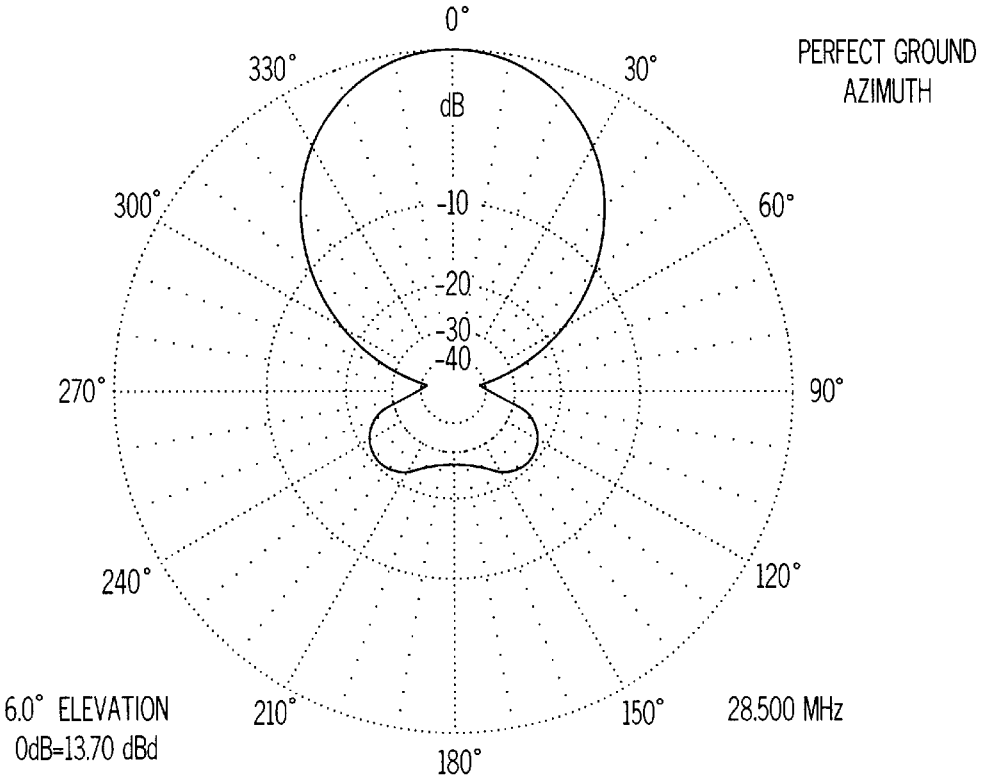
Figure 27E:
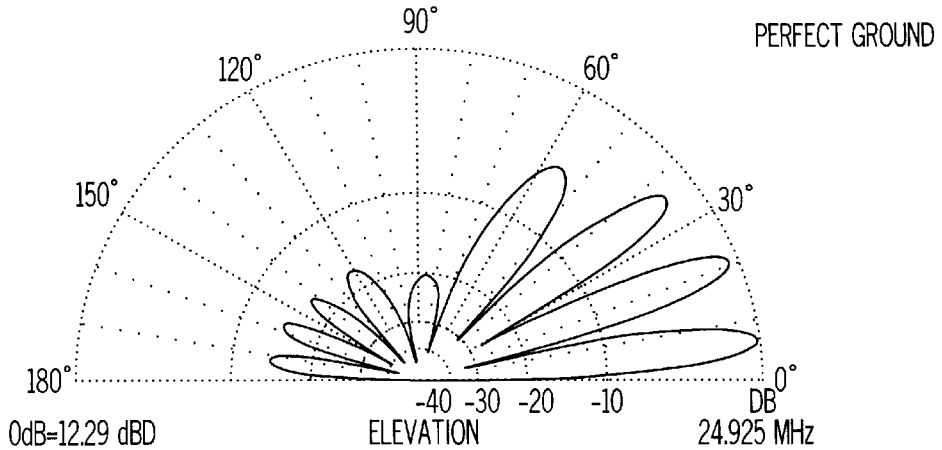
FIG. 27E and 27F illustrates radiation patterns for the antenna of FIG. 27A operating at 24.9 MHz.
Figure 27F:
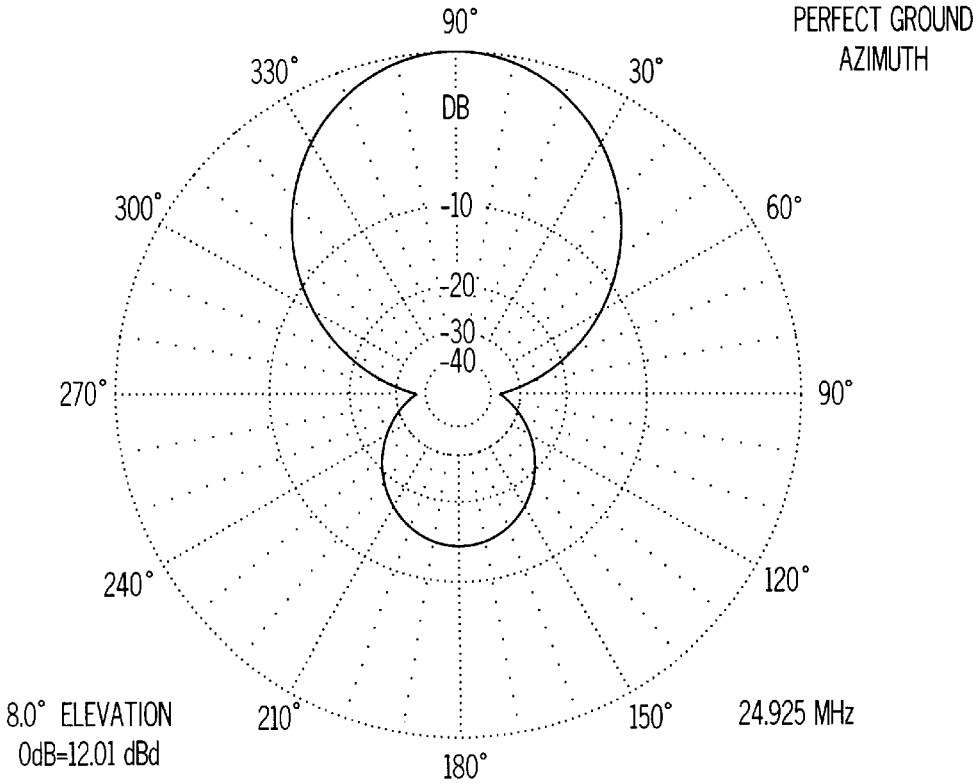

In another variation of the invention, the three-band dipole array is enhanced by adding reflectors for each of the three bands. It should be noted that the present invention also demonstrates that reflector elements for different frequency ranges can be spaced close (within inches) to another without disrupting their respective functions, contrary to the prior art practice of using greater spacing to avoid destructive interaction. As can be seen in FIG. 24, the reflector 680 for 10 MHz is outside and within inches of the 18 MHz 670 reflector. The 24 MHz reflector 660 is located inside the 18 MHz 670 reflector, towards the driven cell 630, 640, 650. Rather than only include parasitic directors for the highest frequency band (24 MHz), as in the previous examples, it was desired to include them for both 18 and 24 MHz, thereby extending the scope of the present invention. The center dipole 610 of the director sleeve is tuned as a director for 18 MHz and the outer sleeve elements 600 and 620 are tuned as 28.9 MHz directors. Varying the physical spacing 605 and 615 between the sleeve elements (600, 620) and the center (610), as well as adjusting the lengths, the director function of the traditional Yagi antenna is recovered for two bands in a single element position without the use of traps. The performance of the present invention adapted to three bands in a Yagi configuration is shown in FIG. 24, FIG. 25 and FIG. 26. As can be seen, the system performs admirably and can be fed with a single feedline and no matching network.

The open-sleeve driven cell can be adjusted to effect input impedances of over 100 ohms by adjusting the spacing, length and the diameter ratios of the cell elements. The use of computer modeling will aid in this effort; however, care must be exercised in the definition of segment size in terms of wavelength to ensure accurate results. This is especially important when close spacings are used. Actual dimensions of antennas used as exhibits are included. A 24 and 28 MHz antenna utilizing the present invention is shown in FIG. 27

The antenna shown in FIG. 27 includes director elements 700, 710, 720, 730, 740; center driver element 750 and adjacent driver elements 752 and 754; and reflectors 760 and 770.

Although the invention has been described in conjunction with various embodiments, it will be appreciated that various modifications and alterations might be made by those skilled in the art without departing from the spirit and scope of the invention.

I claim:

1. A low loss antenna that is operable on at least three separate frequency bands comprising:

a trapless driven element resonant at a single first frequency;

a first adjacent element adjacent to the driven element on a first side of the driven element, the first adjacent element being electrically shorter than the driven element, said first adjacent element spaced apart from the driven element and resonant at a second frequency at least 1.14 times the first frequency;

a second adjacent element adjacent to the driven element on a second side of the driven element, said second adjacent element being electrically shorter than the driven element and the first adjacent element, said second adjacent element spaced apart from the driven element and resonant at a third frequency less than 2.5 times the first frequency and at least 1.14 times the second frequency; and a common feed point located at the driven element for coupling to a feedline for feeding signal energy to the driven element.

2. The low loss antenna as set forth in claim 1, wherein the driven element, first adjacent element and second adjacent element are dipole elements.

3. The low loss antenna as set forth in claim 2, further comprising at least one reflector positioned on a second side of the plurality of dipole elements opposite the first side.

4. The low loss antenna as set forth in claim 1, further comprising at least one director positioned on a first side of the driven element.

5. The low loss antenna as set forth in claim 4, further comprising at least one reflector positioned on a second side of the driven element opposite the first side.

6. The low loss antenna as set forth in claim 1, further comprising a least one multi-element director cell, each director cell comprising a center director element and at least one adjacent director element located on each side of the center director element, each of the adjacent director elements being electrically shorter than the center director element.

7. The low loss antenna as set forth in claim 6, wherein the length the driven and adjacent elements and the spacing between the center and adjacent elements are set so that the feed point impedance to the antenna is substantially similar to the characteristic impedance of the feedline.

8. The low loss antenna as set forth in claim 1, wherein the electrical length of the first adjacent element is at least 14% greater than the electrical length of the second adjacent element.

9. A low loss antenna comprising:

a trapless driven element resonant at a single first frequency in a first frequency band;

a first adjacent element adjacent to the driven element on a first side of the driven element, said first adjacent element spaced apart from the driven element and resonant at a second frequency in a second frequency band, said second frequency being at least 1.14 times the first frequency;

a second adjacent element adjacent to the driven element on a second side of the driven element, said second adjacent element spaced apart from the driven element and resonant at a third frequency in a third frequency band, said third frequency being less than 2.5 times the first frequency and at least 1.14 times the second frequency; and a common feed point located at the driven element for coupling to a feedline for feeding signal energy to the driven element.

10. The low loss antenna as set forth in claim 9, wherein the driven element, first adjacent element and second adjacent element are dipole elements.

11. The low loss antenna as set forth in claim 10, further comprising at least one reflector positioned on a second side of the plurality of dipole elements opposite the first side.

12. The low loss antenna as set forth in claim 9, further comprising at least one director positioned on a first side of the driven element.

13. The low loss antenna as set forth in claim 12, further comprising at least one reflector positioned on a second side of the driven element opposite the first side.

14. The low loss antenna as set forth in claim 9, further comprising a least one multi-element director cell, each director cell comprising a center director element and at least one adjacent director element located on each side of the center director element, each of the adjacent director elements being electrically shorter than the center director element.

15. The low loss antenna as set forth in claim 14, wherein the length of the driven and adjacent elements and the spacing between the center and adjacent elements are set so that the feed point impedance to the antenna is substantially similar to the characteristic impedance of the feedline.

16. The low loss antenna as set forth in claim 9, wherein the electrical length of the first adjacent element is at least 14% greater than the electrical length of the second adjacent element.

17. A low loss antenna comprising:

a driven element resonant at a first frequency, not resonant at a second frequency, and not resonant at a third frequency;

a first adjacent element adjacent to the driven element on a first side of the driven element, said first adjacent element spaced apart from the driven element and resonant at the second frequency, not resonant at the first frequency, and not resonant at the third frequency; and a second adjacent element adjacent to the driven element on a second side of the driven element, said second adjacent element spaced apart from the driven element and resonant at the third frequency, not resonant at the first frequency, and not resonant at the second frequency; and a common feed point located at the driven element for coupling to a feedline for feeding signal energy to the driven element;

where the second frequency is at least 1.14 times the first frequency, the third frequency is at least 1.14 times the second frequency, and the third frequency is less than two and one-half times the first frequency.

18. The low loss antenna as set forth in claim 17, wherein the driven element, first adjacent element and second adjacent element are dipole elements.

19. The low loss antenna as set forth in claim 18, further comprising at least one reflector positioned on a second side of the plurality of dipole elements opposite the first side.

20. The low loss antenna as set forth in claim 17, further comprising at least one director positioned on a first side of the driven element.

21. The low loss antenna as set forth in claim 19, further comprising at least one reflector positioned on a second side of the driven element opposite the first side.

22. The low loss antenna as set forth in claim 17, further comprising a least one multi-element director cell, each director cell comprising a center director element and at least one adjacent director element located on each side of the center director element, each of the adjacent director elements being electrically shorter than the center director element.

23. The low loss antenna as set forth in claim 22, wherein the length of the driven and adjacent elements and the spacing between the center and adjacent elements are set so that the feed point impedance to the antenna is substantially similar to the characteristic impedance of the feedline.

24. The low loss antenna as set forth in claim 17, wherein the electrical length of the first adjacent element is at least 14% greater than the electrical length of the second adjacent element.

25. The low loss antenna as set forth in claim 17, whereby the antenna effectively radiates energy in three non-overlapping frequency bands.

26. The low loss antenna as set forth in claim 25, where the three non-overlapping frequency bands are chosen from United States amateur radio high frequency bands.

27. The low loss antenna as set forth in claim 17, where the driven element has a first half-power bandwidth, the first adjacent element has a second half-power bandwidth that does not overlap the first half-power bandwidth, and the second adjacent element has a third half-power bandwidth that does not overlap the first half-power bandwidth and does not overlap the second half-power bandwidth.

28. A low loss antenna that is operable on at least three separate frequency bands comprising:

a trapless driven element resonant at a single first frequency selected from a range between 14.0 to 14.35 MHz;

a first adjacent element adjacent to the driven element on a first side of the driven element, the first adjacent element being electrically shorter than the driven element, said first adjacent element spaced apart from the driven element and resonant at a second frequency selected from a range between 21.0 to 21.45 MHz;

a second adjacent element adjacent to the driven element on a second side of the driven element, said second adjacent element being electrically shorter than the driven element, said second adjacent element spaced apart from the driven element and resonant at a third frequency selected from a range between 28.0 to 29.7 MHz; and a common feed point located at the driven element for coupling to a feedline for feeding signal energy to the driven element.

29. A low loss antenna comprising:

a trapless driven element resonant at a single first frequency in a first frequency band between 14.0 to 14.35 MHz;

a first adjacent element adjacent to the driven element on a first side of the driven element, said first adjacent element spaced apart from the driven element and resonant at a second frequency in a second frequency band between 21.0 to 21.45 MHz;

a second adjacent element adjacent to the driven element on a second side of the driven element, said second adjacent element spaced apart from the driven element and resonant at a third frequency in a third frequency band between 28.0 to 29.7 MHz; and a common feed point located at the driven element for coupling to a feedline for feeding signal energy to the driven element.

30. A low loss antenna comprising:

a driven element resonant at a first frequency between 14.0 and 14.35 MHz, not resonant at a second frequency between 21.0 and 21.45 MHz, and not resonant at a third frequency between 28.0 and 29.7 MHz;

a first adjacent element adjacent to the driven element on a first side of the driven element, said first adjacent element spaced apart from the driven element and resonant at the second frequency, not resonant at the first frequency, and not resonant at the third frequency; and a second adjacent element adjacent to the driven element on a second side of the driven element, said second adjacent element spaced apart from the driven element and resonant at the third frequency, not resonant at the first frequency, and not resonant at the second frequency; and a common feed point located at the driven element for coupling to a feedline for feeding signal energy to the driven element.

31. A low loss antenna that is operable on at least three separate frequency bands comprising:

a trapless driven element resonant at a single first frequency that is substantially 10.1 MHz;

a first adjacent element to the driven element on a first side of the driven element, the first adjacent element being eletrically shorter than the driven element, said first adjacent element spaced apart from the driven element and resonant at a second frequency that is substantially 18.1 MHz;

a second adjacent element adjacent to the driven element on a second side of the driven element, the second adjacent element being electrically shorter than the driven element, said second adjacent element spaced apart from the driven element and resonant at a third frequency that is substantially 24.9 MHz; and a common feed point located at the driven element for coupling to a feedline for feeding signal energy to the driven element.

32. A low loss antenna comprising:

a trapless driven element resonant at a single first frequency in a first frequency band between 10.1 to 10.15 MHz;

a first adjacent element adjacent to the driven element on a first side of the driven element, said first adjacent element spaced apart from the driven element and resonant at a second frequency in a second frequency band between 18.068 to 18.168 MHz;

a second adjacent element adjacent to the driven element on a second side of the driven element, said second adjacent element spaced apart from the driven element and resonant at a third frequency in a third frequency band between 24.89 to 24.99 MHz; and a common feed point located at the driven element for coupling to a feedline for feeding signal energy to the driven element.

33. A low loss antenna comprising:

a driven element resonant at a first frequency between 14.0 and 14.35 MHz, not resonant at a second frequency between 21.0 and 21.45 MHz, and not resonant at a third frequency between 28.0 and 29.7 MHz;

a first adjacent element adjacent to the driven element on a first side of the driven element, said first adjacent element spaced apart from the driven element and resonant at the second frequency, not resonant at the first frequency, and not resonant at the third frequency; and a second adjacent element adjacent to the driven element on a second side of the driven element, said second adjacent element spaced apart from the driven element and resonant at the third frequency, not resonant at the first frequency, and not resonant at the second frequency; and a common feed point located at the driven element for coupling to a feedline for feeding signal energy to the driven element.

* * * * *